US006464342B1

(12) United States Patent
Kubota et al.

(10) Patent No.: US 6,464,342 B1
(45) Date of Patent: Oct. 15, 2002

(54) LIQUID DISCHARGE HEAD, HEAD CARTRIDGE MOUNTED ON LIQUID DISCHARGE HEAD AND LIQUID DISCHARGE APPARATUS, AND METHOD FOR MANUFACTURING LIQUID DISCHARGE HEAD

(75) Inventors: Masahiko Kubota, Tokyo; Ichiro Saito, Yokohama; Toshio Kashino, Chigasaki; Yoshiyuki Imanaka, Kawasaki; Teruo Ozaki; Muga Mochizuki, both of Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/453,813

(22) Filed: Dec. 3, 1999

(30) Foreign Application Priority Data

Dec. 3, 1998 (JP) ..... 10-344723
Dec. 3, 1998 (JP) ..... 10-344725
Nov. 25, 1999 (JP) ..... 11-334369

(51) Int. Cl.[7] ..... B41J 2/05
(52) U.S. Cl. ..... 347/63; 347/65
(58) Field of Search ..... 347/56, 63, 65, 347/67

(56) References Cited

U.S. PATENT DOCUMENTS 4,723,129 A 2/1988 Endo et al. ..... 347/56
5,278,585 A * 1/1994 Karz et al. ..... 347/65
5,838,351 A 11/1998 Weber ..... 347/85

FOREIGN PATENT DOCUMENTS

| | | | |
|---|---|---|---|
| EP | 0 665 590 | 8/1995 | ..... H01L/23/00 |
| EP | 0 745 479 | 12/1996 | ..... B41J/2/14 |
| EP | 9201966 | 8/1997 | ..... B41J/2/05 |
| EP | 0 813 967 | 12/1997 | ..... B41J/2/14 |
| EP | 0 819 534 | 1/1998 | ..... B41J/2/05 |
| EP | 0 895 861 | 2/1999 | ..... B41J/2/05 |
| EP | 0 920 998 | 6/1999 | ..... B41J/2/05 |

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

A liquid discharge head at least comprises a discharge opening for discharging the liquid, a liquid flow channel in communication with the discharge opening and for supplying the liquid to the discharge opening, a substrate equipped with a heat generator for producing a bubble in the liquid that is filled in the liquid flow channel, and a movable plate supported and fixed onto the substrate at a position of the substrate opposed to the heat generator and with a gap from the substrate, with a free end on the discharge opening side. The liquid discharge head can discharge the liquid from the discharge openings by forcing the free end of the movable plate to be displaced toward the discharge opening around a fulcrum portion made near a support and fixing portion of the movable plate with the substrate due to pressure caused by produced bubble.

34 Claims, 20 Drawing Sheets

PRIOR ART

LIQUID DISCHARGE HEAD, HEAD CARTRIDGE MOUNTED ON LIQUID DISCHARGE HEAD AND LIQUID DISCHARGE APPARATUS, AND METHOD FOR MANUFACTURING LIQUID DISCHARGE HEAD

BACKGROUND OF THE INVENTION

1. Field of the Invention

The present invention relates to a liquid discharge head for use in a printer or video printer which is used as an output terminal for a copying machine, facsimile apparatus, word processor or host computer, a manufacturing method for said liquid discharge head, a head cartridge having said liquid discharge head mounted thereon, and a liquid discharge apparatus. In particular, this invention relates to a liquid discharge head comprising a substrate formed with electrothermal converting elements for producing heat energy for use as the energy for recording, which performs the recording by discharging the recording liquid (ink or the like) as flying liquid droplets from the discharge openings (orifices) onto the recording medium, a manufacturing method for said liquid discharge head, a head cartridge having said liquid discharge head mounted thereon, and a liquid discharge apparatus.

Note that "recording" in this invention means applying meaningful images such as characters or figures, as well as other images such as patterns, onto the recording medium.

2. Related Background Art

An ink jet recording method or so-called bubble jet recording method has been conventionally well-known, which forms the image by applying the heat energy to cause the state change accompanying rapid volume change to occur in the ink and discharging the ink from the discharge openings using working force by this state change of ink. A recording apparatus relying on this bubble jet recording method is typically provided with discharge openings for discharging the ink, and ink flow channels in communication with these discharge openings, and heating elements (electrothermal converting elements) as energy generating means for discharging the ink disposed in the ink flow channels, as disclosed in U.S. Pat. No. 4,723,129.

With such recording method, a high quality image can be recorded at high speed and with low noise, and because the head for this recording method allows the discharge openings for discharging the ink to be arranged at high density, there are many good advantages such as easily producing a recording image of high resolution, or, further, a color image, with a small apparatus. Therefore, this bubble jet recording method has been recently utilized for many types of office equipment such as printers, copying machines, and facsimile apparatus, and further has come into use for industrial systems such as printing machines.

Development of this bubble jet technology into a variety of products has raised the following various demands in recent years.

For example, examining the request to improve the energy efficiency includes regulating the thickness of the protective film in the heating element. This examination is effective in improving the efficiency of transferring the produced heat to liquid.

In order to obtain a high quality image, there have been proposed the driving conditions to provide a liquid discharge method which is capable of discharging the ink excellently based on the stable production of bubbles, with high rate of discharging the ink, and from the viewpoint of high speed recording, the improved shape of liquid flow channels to obtain a liquid discharge head with high rate of filling the ink to be discharged into the liquid flow channels.

Turning back to the principle of discharging the liquid, careful research has been made to provide a novel liquid discharge method using the bubbles that have never been obtained conventionally, and a head for use therewith, as proposed in Japanese Patent Application Laid-Open No. 9-201966.

In the following, a conventional liquid discharge method and a head for use therewith as disclosed in Japanese Patent Application Laid-Open No. 9-201966 will be described with reference to FIGS. 19A to 19D. FIGS. 19A to 19D are views for explaining the discharge principle in a conventional liquid discharge head, or a cross-sectional view taken in a direction of liquid flow channels. Also, FIG. 20A is a perspective view, partially broken, of the liquid discharge head as shown in FIGS. 19A to 19D. The liquid discharge head as shown in FIGS. 19A to 19D is the most fundamental constitution for enhancing the discharge power or discharge efficiency by controlling the propagation direction of pressure caused by bubble or the growth direction of bubble in discharging the liquid.

Note that "upstream" and "downstream" as used in the following description are taken with respect to the flow direction in which liquid passes from a liquid supply source via above a bubble producing region (or movable member) to the discharge openings.

The term "downstream" in respect of a bubble itself is represented by the portion of bubble on the discharge opening side which is supposed to directly take effect in the discharging of a liquid droplet. More specifically, it means the bubble produced in the heating element downstream in the flow direction as above or the constitutional direction relative to the center of bubble, or in the downstream region from its areal center.

Furthermore, "comb tooth" refers to the shape having the support of a movable member as a common member and its free end opened.

In an example of FIGS. 19A to 19D, a liquid discharge head is provided with a heat generator 1102 for applying heat energy on the liquid, as the discharge energy generating element to discharge the liquid, on an element substrate 1101, a liquid flow channel 1103 being disposed, corresponding to the heat generator 1102, above this element substrate 1101. The liquid flow channel 1103 is in communication with a discharge opening 1104, as well as a common liquid chamber 1105 for supplying the liquid to a plurality of liquid flow channels, from which the liquid in an amount corresponding to the liquid discharged from the discharge opening 1104 is received.

On the element substrate 1101 in this liquid flow channel, a planar movable plate 1106 made of elastic material such as metal is provided opposed to the heat generator 1102 and in cantilever form. This movable plate 1106 is fixed at its one end to a plate base (support member) 1107 formed by patterning photosensitive resin on a wall of the liquid flow channel 1103 or the element substrate 1101. Thereby, the movable plate 1106 is held on the plate base 1107, with a fulcrum (support portion) 1108.

By making the movable plate 1106 like a comb-tooth, it can be fabricated simply and easily, and the alignment for the plate base 1107 can be made easily.

This movable plate 1106 is disposed at a position facing and covering the heat generator 1102, about 15 $\mu$m away, so as to have the fulcrum (support portion: fixed end) 1108 upstream in the great flow passing from the common liquid chamber 1105 via above the movable plate 1106 to the discharge opening 1104 by operation of discharging the liquid, and the free end downstream of this fulcrum 1108. A bubble producing region 1110 is between this heat generator 1102 and the movable plate 1106.

By generating heat with the heat generator 1102 and applying that heat to the liquid in the bubble producing region 1110 between the movable plate 1106 and the heat generator 1102, a bubble 1111 is produced in that liquid, based on the film boiling phenomenon as described in U.S. Pat. No. 4,723,129 (see FIG. 19B). The pressure caused by the produced bubble 1111 will act predominantly on the movable plate 1106, to displace the movable plate 1106 around the fulcrum 1108 to be open toward the discharge opening 1104, as shown in FIGS. 19B, 19C or FIGS. 20A and 20B. By displacement of the movable plate 1106 or displaced state, the pressure caused by produced bubble 1111 is propagated or the growth of bubble 1111 itself led to the discharge opening 1104. At this time, the top end portion of the free end 1109 has a width, which makes it easier to lead bubbling power of the bubble 1111 to the discharge opening 1104, with radical improvements in the discharge efficiency of liquid droplet, discharge power or discharge rate.

As described above, a technique disclosed in Japanese Patent Application Laid-Open No. 9-201966 is one in which the positional relation between the fulcrum of movable plate and the free end in the liquid channel is locating the free end on the discharge opening side or downstream, and the production of a bubble is positively controlled by disposing the movable plate opposed to the heat generator or bubble producing region.

Another example of a conventional liquid discharge head is shown in FIG. 20B. Each constitution of an element substrate 1201, a heat generator 1202, a liquid flow channel 1203, a discharge opening 1204, a common liquid chamber 1205 and a bubble producing region 1209 for the liquid discharge head as shown in FIG. 20B is the same as that of the liquid discharge head as shown in FIG. 20A, and ] a material that contains silicon as the material thereof. More specifically, it is preferable to use silicon nitride, silicon oxide, or silicon carbide.

Also, it is preferable to have an oxide thin film between each layer constituting said movable plate to suppress the grain growth of each layer of material containing silicone more effectively. As above described, the movable plate made of material containing silicon can be formed by plasma CVD.

Further, the outer peripheral end face of the movable member may be in the form of saw teeth in the thickness direction of the movable member.

In this respect, although described in the embodiments in detail below, one-time film formation process of the present invention is the film formation process where the density, composition, and the like of the film formed in each process are different on the substrate side thereof and on the side opposite thereto. For example, if the temperature changes are repeated several cycles in continuation in the CVD apparatus, it is assumed that one cycle portion thereof is the one-time film formation process.

In order to achieve the above objects, according to the present invention, there is provided a liquid discharge head, according to other embodiment, at least comprising a discharge opening for discharging the liquid, a liquid flow channel in communication with said discharge opening and for supplying said liquid to said discharge opening, a substrate equipped with a heat generator for producing a bubble in the liquid that is filled in the liquid flow channel, and a movable plate supported and fixed onto said substrate at a position of said substrate opposed to said heat generator and with a gap from said substrate, with a free end on the discharge opening side, said liquid discharge head discharging the liquid from the discharge openings by forcing the free end of said movable plate to be displaced toward said discharge opening around a fulcrum portion made near a support and fixing portion of said movable plate with said substrate due to pressure caused by produced bubble. The movable member is formed in a structure where three layers or more are laminated, each with a layer having different Young's modulus from the adjacent area.

Here, the "layer" of the present invention is different from the "film" formed in the aforesaid one-time film formation process, but it indicates one whose density and composition are different from the adjacent layer. In this respect, the layer may present a definite separation from the adjacent one. However, a layer that does not show any definite separation from the adjacent layer is assumed to be included in the term "layer" of the present invention.

In accordance with the structure described above, the three layers or more are formed in a laminated structure each having different Young's modulus from the adjacent area. Therefore, the growth of grains within the movable plate can be suppressed to cut off linkage of the grain boundary, providing a greater allowance of flexibility for the movable portion (particularly the fulcrum portion) accompanied with displacement of the movable plate, resulting in increased strength of the movable plate and more durability of the movable plate.

Furthermore, it is preferred that said movable plate has such a structure that a layer made of a material having a relatively low Young's modulus is sandwiched between the layers of a material having a relatively high Young's modulus.

In addition, the material having a relatively low Young's modulus may be silicone oxide, and the material having a relatively high Young's modulus may be silicon nitride or silicon carbide. Also, the alloy containing aluminum may be Al—Cu, Al—Ni, Al—Cr, Al—Co, or Al—Fe. The plate base between the support and fixing portion of said movable plate and the substrate can provide the increased strength of connecting the support and fixing portion of the movable plate with the substrate is increased and the greater mechanical durability of the movable plate.

Further, the material for the plate base may contain Ti, or tantalum.

Also, in accordance with still another embodiment of the present invention, the liquid discharge head is provided with at least the discharge ports for discharging liquid, the liquid flow paths communicated with the discharge ports for supplying the liquid to the discharge ports, the substrate provided with heat generating elements for creating bubbles in the liquid filled in each of the liquid flow paths; and the movable members arranged in the position facing the heat generating elements on the substrate with a gap to it, and supported and fixed on the substrate with the free end thereof being on the discharge port side, and this liquid discharge head discharges the liquid from the discharge ports by displacing the free end of the movable members to the discharge port side centering on the fulcrum structured near the supporting and fixing portion of the movable members with the substrate. For this head, the outer peripheral end face of the movable member is in the form of saw teeth in the thickness direction of the movable member.

Here, the phrase "in the form of saw teeth in the thickness direction" in the description of the present invention means the area and outer circumferential length of the section orthogonal to the thickness direction of the movable member which are caused to change larger to smaller to larger in that order, respectively, for example.

When ink flows in the nozzle by the development and extinction of the bubble created by the heat generating element to displace the movable member, turbulent occurs due to the outer peripheral end face of the saw teeth shape of the kind. As a result, even if ultrafine bubbles are allowed to reside in each of the flow paths and the common liquid chamber, a turbulence acts to promote the discharge of such fine bubbles through each of the discharge ports, thus suppressing them to move toward the common liquid chamber side.

Also, in accordance with still another embodiment of the present invention, the liquid discharge head is provided with at least the discharge ports for discharging liquid, the liquid flow paths communicated with the discharge ports for supplying the liquid to the discharge ports, and the substrate provided with the heat generating elements for creating bubbles in the liquid filled in each of the liquid flow paths; and the movable members arranged in the position facing the heat generating elements on the substrate with a gap to it, and supported and fixed on the substrate with the free end thereof being on the discharge port side, and this liquid discharge head discharges the liquid from the discharge ports by displacing the free end of the movable members to the discharge port side centering on the fulcrum structured near the supporting and fixing portion of the movable members with the substrate. For this head, the outer peripheral and face of the movable member is in the form of saw teeth in the direction intersecting the thickness direction of the movable members.

Here, the phrase "in the form of saw teeth in the direction intersecting the thickness direction" in the description of the present invention means an arbitrary outer circumferential section orthogonal to the thickness direction of the movable member, which is provided with fine irregular portions.

For the structure described above, ink layer is present between fine gaps between the nozzle side walls and movable members, respectively. With the ink flow in each nozzle which takes place by the development and extinction of the bubble created by each heat generating element, each movable member is displaced vertically. At this juncture, slide stress acts upon the movable member. In order to enhance the response capability of the movable member, there is a need for reducing this slide stress. However, since the ink layer is present in the fine gap between the nozzle side walls and each movable member, it becomes possible to reduce the slid stress without spoiling the function of each movable member to suppress the ink flow to the backward side, hence improving the response capability of each movable member.

Also, in accordance with still another embodiment of the present invention, the liquid discharge head is provided with at least the discharge ports for discharging liquid, the liquid flow paths communicated with the discharge ports for supplying the liquid to the discharge ports, and the substrate provided with the heat generating elements for creating bubbles in the liquid which is filled in each of the liquid flow paths, and the movable members arranged in the position facing the heat generating elements on the substrate with a gap to it, and supported and fixed on the substrate with the free end thereof being on the discharge port side, and this liquid discharge head discharges the liquid from the discharge ports by displacing each free end of the movable members to the discharge port side centering on the fulcrum structured near the supporting and fixing portion of the movable members with the substrate. For this liquid discharge head, the density of the material that forms the movable members on the bonding area with the substrate is smaller than the density of the material that forms the movable members in other areas.

Also, in accordance with still another embodiment of the present invention, the liquid discharge head is provided with at least the discharge ports for discharging liquid, the liquid flow paths communicated with the discharge ports for supplying the liquid to the discharge ports, and the substrate provided with the heat generating elements for creating bubbles in the liquid which is filled in each of the liquid flow paths, and the movable members arranged in the position facing the heat generating elements on the substrate with a gap to it, and supported and fixed on the substrate with the free end thereof being on the discharge port side, and this liquid discharge head discharges the liquid from the discharge ports by displacing each free end of the movable members to the discharge port side centering on the fulcrum structured near the supporting and fixing portion of the movable members with the substrate. For this liquid discharge head, the pedestal portion is arranged between the supporting and fixing portion of the movable members and the substrate, and at the same time, the density of the material for the formation of the movable members in the bonding area with the pedestal portion is smaller than the density of the material for the formation of the movable members in the other area.

With the structure as described above, the sparse region is formed on the bonding area with the substrate surface of the movable members (or the pedestal portion), hence making it possible to suppressing the abrupt changes of stress when the movable members are formed. As a result, the bonding force becomes stronger between the movable members and the substrate surface (or the pedestal portion) on the bonding area. Then, when the free ends of the movable members are displaced by the pressure exerted by the creation of bubbles for the utilization of discharging liquid, the discharge characteristics are stabilized for the provision of a highly reliable liquid discharge head.

A cartridge of the invention has the liquid discharge head of the invention and a liquid container for holding the liquid to be supplied to the liquid discharge head.

A liquid discharge apparatus of the invention has the liquid discharge head of the invention and drive signal supplying means for supplying a drive signal to discharge the liquid from the liquid discharge head.

Also, a manufacturing method of the liquid discharge head of the invention comprising a discharge opening for discharging the liquid, a liquid flow channel in communication with said discharge opening and for supplying said liquid to said discharge opening, a substrate equipped with a heat generator for producing a bubble in the liquid that is filled in the liquid flow channel, and a movable plate supported and fixed onto said substrate at a position of said substrate opposed to said heat generator and with a gap from said substrate, with a free end on the discharge opening side, said liquid discharge head discharging the liquid from the discharge openings by forcing the free end of said movable plate to be displaced toward said discharge opening around a fulcrum portion made near a support and fixing portion of said movable plate with said substrate due to pressure caused by produced bubble is characterized by including a process of building up a gap formation member for forming said gap on said substrate, a first step of forming film for use of the movable members for the film formation of the substrate portion becoming the movable members on the substrate and the gap formation members, a second step of forming film for use of the movable members for the further film formation of the substrate portion becoming the movable members after the first step of forming the substrate film for use of the movable members, a process of forming said movable plate by patterning a base portion for said movable plate, and a process for removing said gap formation member.

By the manufacturing method as above, a movable plate superior in durability can be fabricated by providing several processes for forming the base portion for the movable plate. The material of the base portion for the movable plate desirably contains silicon, and specifically, may be silicon nitride, silicon oxide or silicon carbide.

Also, in layering the material containing silicon, an oxide film is formed on the surface of the material containing silicon, and a next layer is formed on this oxide thin film, suppressing the grain growth between each layer owing to the oxide thin film, resulting in greater durability of the movable plate. Such oxide thin film can be formed by leaving away the substrate in the atmosphere after forming the layer of the material containing silicon in vacuum, and particularly, the layer of the material containing silicon can be formed by plasma CVD.

Furthermore, the gap formation member may be formed by sputtering aluminum or aluminum alloy, and removed by wet etching with a mixture liquid of acetic acid, nitric acid, and hydrochloric acid. Thereby, the peripheral end face of the movable plate can be made the saw-tooth configuration.

Another manufacturing method of the liquid discharge head of the invention comprising a discharge opening for discharging the liquid, a liquid flow channel in communication with said discharge opening and for supplying said liquid to said discharge opening, a substrate equipped with a heat generator for producing a bubble in the liquid that is filled in the liquid flow channel, and a movable plate supported and fixed onto said substrate at a position of said substrate opposed to said heat generator and with a gap from said substrate, with a free end on the discharge opening side, said liquid discharge head discharging the liquid from the discharge openings by forcing the free end of said movable plate to be displaced toward said discharge opening around a fulcrum portion made near a support and fixing portion of said movable plate with said substrate due to pressure caused by produced bubble, includes a process of forming a pad protective layer for protecting a pad for electrical connection on said substrate, a process of forming a gap formation member for forming said gap on said substrate and said pad protective layer, a process of laminating layers each having different Young's modulus from the adjacent area in three or more layers forming a movable plate base portion which serves as the movable plate on said substrate, said pad protective layer and said gap formation member, a process of forming said movable plate by patterning said movable plate base portion, a process for removing said gap formation member, and a process of removing an exposed portion of said pad protective layer.

Thereby, the liquid discharge head can be fabricated with increased allowance for flexibility of the movable portion (particularly fulcrum portion) accompanied with the displacement of the movable plate, which provides the greater strength of the movable plate and enhanced durability of the movable plate.

Further, the process of forming the movable plate by patterning the movable plate base portion preferably includes a subprocess of forming a structure in which the layer having relatively low Young's modulus is sandwiched between the layers having relatively high Young's modulus.

Also, in accordance with still another embodiment of the present invention, a method for manufacturing a liquid discharge head, which is provided with discharge ports for discharging liquid; liquid flow paths communicated with the discharge ports for supplying the liquid to the discharge ports; the substrate provided with the heat generating elements for creating bubbles in the liquid filled in each of the liquid flow paths; and movable members arranged in the position facing the heat generating elements on the substrate with a gap thereto, and supported and fixed on the substrate with the free end thereof being on the discharge port side, and the liquid being discharged from the discharge ports by displacing the free end of the movable members to the discharge port side centering on the fulcrum structured near the supporting and fixing portion of the movable members with the substrate, comprises the steps of: forming the pad protection layer on the substrate to protect pads for use of electrical connection; forming the gap formation members on the substrate and the pad protection layer for the formation of the gap; forming the substrate portion for use of the movable members becoming the movable members on the pedestal portion, the pad protection layer, and the gap formation members so as to make the density of material for the formation of the movable members smaller in the bonding area with the pedestal portion than the density of material for the formation of the movable members in the other area; forming the movable members by patterning the substrate portion for use of the movable members; removing the gap formation members; and removing the exposed portion of the pad protection layer.

Further, in accordance with still another embodiment of the present invention, a method for manufacturing a liquid discharge head, which is provided with discharge ports for discharging liquid; liquid flow paths communicated with the discharge ports for supplying the liquid to the discharge ports; the substrate provided with the heat generating elements for creating bubbles in the liquid filled in each of the liquid flow paths; and movable members arranged in the position facing the heat generating elements on the substrate with a gap thereto, and supported and fixed on the substrate with the free end thereof being on the discharge port side, and the liquid being discharged from the discharge ports by displacing the free end of the movable members to the discharge port side centering on the fulcrum structured near the supporting and fixing portion of the movable members with the substrate, comprises the steps of forming the pad protection layer on the substrate to protect pads for use of electrical connection; forming the pedestal portion to be arranged between the supporting and fixing portion of the movable members and the substrate; forming the gap formation members on the substrate and the pad protection layer for the formation of the gap; forming the substrate portion for use of the movable members becoming the movable members on the pedestal portion, the pad protection layer, and the gap formation members go as to make the density of material for the formation of the movable members smaller in the bonding area with the substrate than the density of material for the formation of the movable members in the other area; forming the movable members by patterning the substrate portion for use of the movable members; removing the gap formation members; and removing the exposed portion of the pad protection layer.

DETAILED DESCRIPTION OF THE PREFERRED EMBODIMENTS

The preferred embodiments of the present invention will be described below with reference to the drawings.

Figure 1:
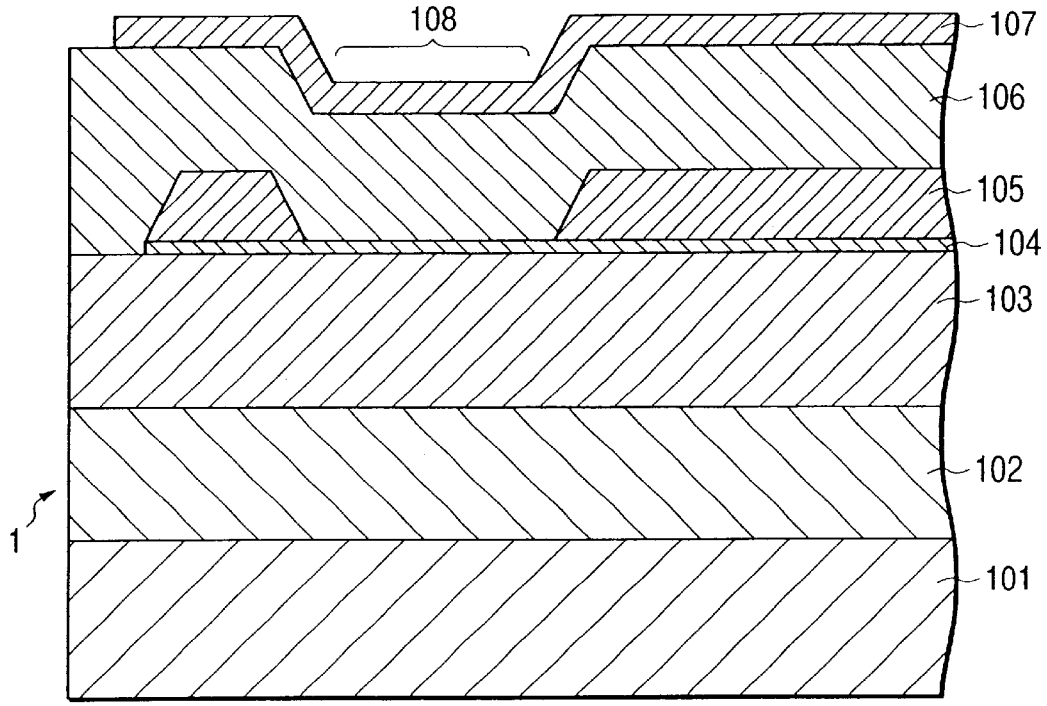
FIG. 1 is a cross-sectional view of a portion corresponding to an ink passageway on a substrate for a liquid discharge head according to the present invention.

FIG. 1 is a cross-sectional view of a portion corresponding to an ink passageway on a substrate for a liquid discharge head substrate according to the present invention. In FIG. 1, numeral 101 represents a silicon substrate, and numeral 102 represents a thermal oxide film which is a heat reserving layer. Numeral 103 represents an $SiO_2$ film or $Si_3N_4$ film which is an interlayer film also used as the heat reserving layer, numeral 104 represents a resistive layer, numeral 105 represents represents an Al alloy wiring made of Al, Al—Si or Al—Cu, and numeral 106 represents an $SiO_2$ film or $Si_3N_4$ film which is a protective film. Numeral 107 represents an anti-cavitation film for keeping the protective film 106 from chemical or physical impact by heating of the resistive layer 104. Numeral 108 represents a heat acting portion for the resistive layer 104 in a region where the electrode wiring 105 is not formed. These driving elements are formed on an Si substrate by semiconductor technology, and the heat acting portion is further formed on the same substrate.

Figure 2:
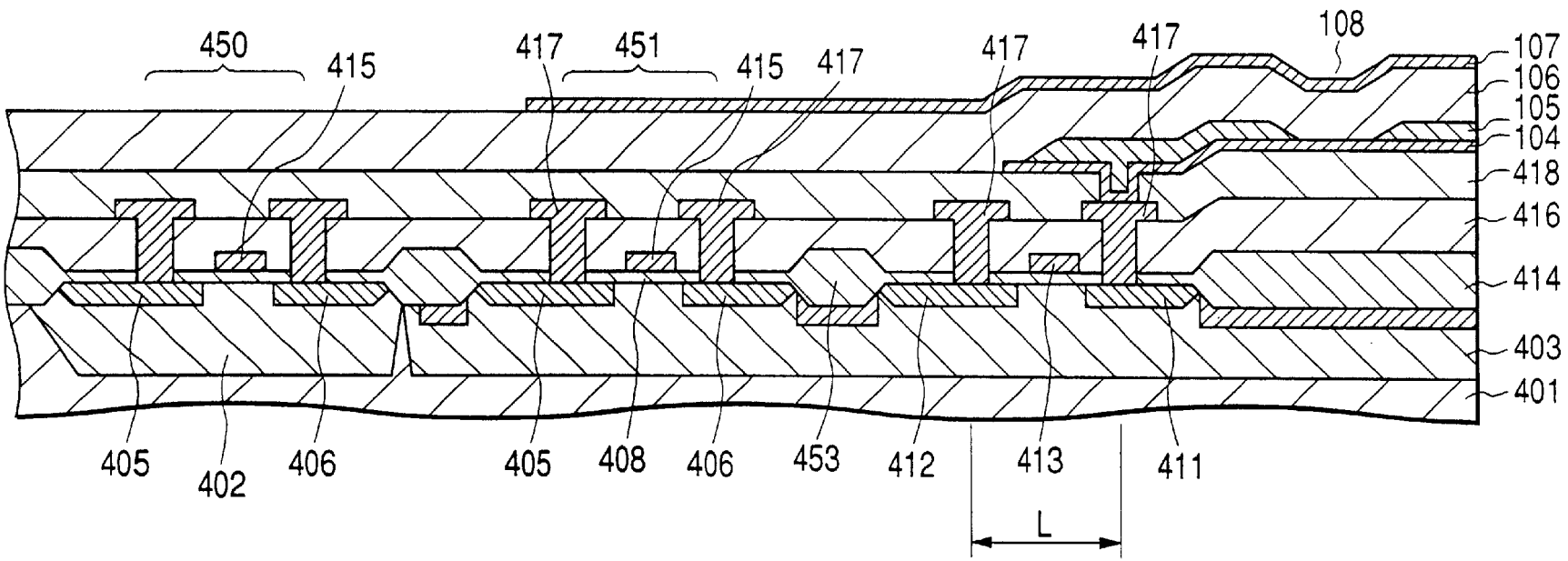
FIG. 2 is a typical cross-sectional view of the main elements on the substrate for the liquid discharge head, taken longitudinally.

FIG. 2 is a typical cross-sectional view of a substrate for the liquid discharge head, taken along the main elements longitudinally. On an Si substrate 401 of P-type electric conductor, an N-type well region 402 and P-MOS 450 are made, and a P-type well region 403 and N-MOS 451 are made by impurity introduction such as ion implantation and diffusion, using a general MOS process. P-MOS 450 and N-MOS 451 are each constituted of a gate wiring 415 of poly-Si which is deposited 4000 Å to 5000 Å thick by CVD, a source region 405 into which N-type or P-type impurities are introduced, and a drain region 406, via a gate insulating film 408 several hundreds Å thick, C-MOS logic being constituted by these P-MOS and N-MOS.

Also, an element driving N-MOS transistor is constituted of a drain region 411, a source region 412 and a gate wiring 413 on a P-well substrate which are made by impurity introduction and diffusion process.

While the constitution of N-MOS transistor is exemplified in this embodiment, it should be noted that other transistors may be also used as long as they have the capability of driving a plurality of heating elements individually and the function of implementing the fine structure as above mentioned.

These elements are separated from each other by an oxide film separation region 453 formed 500 Å to 10000 Å thick by field oxidation. This field oxide film acts as a heat reserving layer 414 which is the first layer under the heat acting portion 108.

After forming each element, an interlayer insulating film 416 is deposited about 7000 Å thick as a PSG (Phospho-Silicate Glass) or BPSG (Boron-doped Phospho-Silicate Glass) film by CVD, the flattening is made by heat treatment, and the wiring is made via a contact hole with an Al electrode 417 which is the first wiring layer. Thereafter, an interlayer insulating film 418 such as an $SiO_2$ film is deposited 10000 Å to 15000 Å thick by plasma CVD, and further a resistive layer 104 is formed as a $TaN_{0.8,hex}$ film about 1000 Å thick via a through hole by DC sputtering. Thereafter, a second wiring layer Al electrode which is the wiring to each heat generator is formed.

Then, an $Si_3N_4$ film as a protective film 106 is made about 10000 Å thick by plasma CVD. On the top layer, an anti-cavitation film 107 is deposited about 2500 Å thick with Ta.

Each embodiment of a liquid discharge recording head and a manufacturing method therefor according to the present invention will be described below with reference to FIGS. 3, 4A to 4E, 5A to 5E, 6A to 6C, 7A to 7D, 8, 9A to 9C, 10A to 10H and 11A to 11E.

First Embodiment

Figure 3:
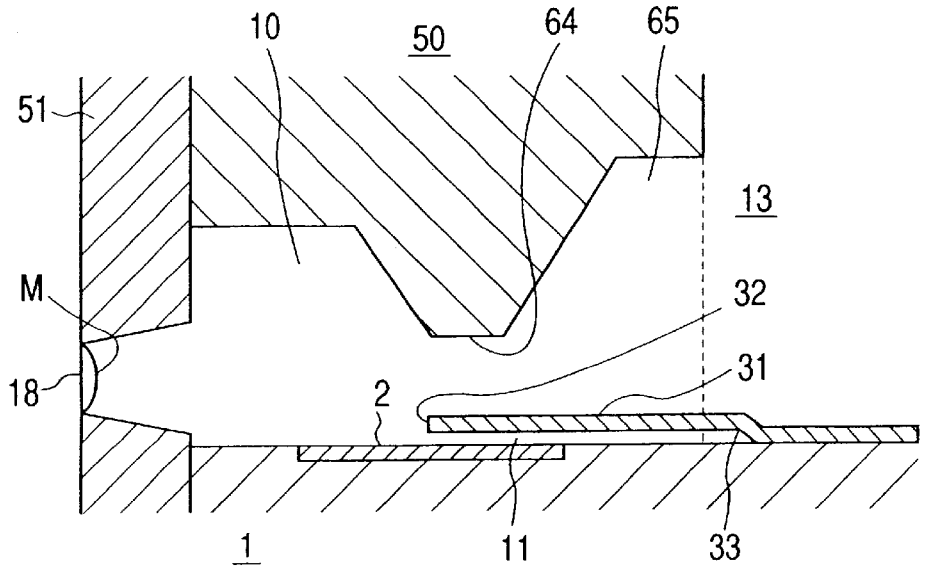
FIG. 3 is a cross-sectional view of the liquid discharge head in a first embodiment of the invention, taken along the liquid flow direction.

FIG. 3 is a cross-sectional view of one embodiment of a liquid discharge head according to the present invention, taken in the liquid flow direction.

The liquid discharge head of this embodiment is provided with a heat generator 2 which applies heat energy on the liquid, as a discharge energy generating element for discharging the liquid, on a smooth element substrate 1, a liquid flow channel 10 being disposed corresponding to the heat generator 2 on the element substrate 1. The liquid flow channel 10 is in communication with a discharge opening 18 which is formed on an orifice plate 51, as well as a common liquid chamber 13 for supplying the liquid to a plurality of liquid flow channels 10, to receive the liquid in an amount corresponding to the liquid discharged from the discharge opening 18 from this common liquid chamber 13. M represents a meniscus which the discharged liquid forms, the meniscus M being well-balanced near the discharge opening 18 against an internal pressure of the common liquid chamber 13 which is normally a negative pressure, by capillary force produced by the discharge opening 18 and an inner wall of the liquid flow channel 10 in communication therewith.

The liquid flow channel 10 is constituted by bonding between the element substrate 1 having the heat generator 2 and a ceiling plate 50, and in the neighboring region of a face where the heat generator 2 makes contact with the discharge liquid, there is a bubble producing region 11 for producing a bubble in the discharge liquid when the heat generator 2 is rapidly heated. This bubble producing region 11 is disposed in the liquid flow channel 10 with a gap so that at least one part of a movable plate 31 is opposed to the heat generator 2. This movable plate 31 is supported and fixed on the element substrate 1, with a free end 32 placed downstream toward the discharge opening 18, and a fulcrum 33 upstream. Particularly in this embodiment, in order to suppress the growth of half bubble upstream which may have effect on the back wave and inertia force of the liquid to the upstream side, the free end 32 is disposed substantially in the center of the bubble producing region 11. And the free end of the movable plate 31 is displaceable around the fulcrum 33 toward the discharge opening 18, along with the growth of a bubble produced in the bubble producing region 11.

A stopper (regulating portion) 64 is located upward and centrally of the bubble producing region 11, regulating the displacement of the movable plate 31 within a certain range to suppress the growth of half bubble upstream. The stopper 64 is formed by partly reducing the distance from the movable plate 31 in the liquid flow channel 10. In the flow from the common liquid chamber 13 to the discharge opening 18, a low flow passage resistance region 65 having a lower flow resistance than the liquid flow channel 10 is provided upstream from the stopper 64. The flow passage structure in this region 65 is reduced in flow resistance from the flow passage upon movement of the liquid, because of no upper wall or a larger cross section of flow passage.

A manufacturing method for the movable plate of the liquid discharge head in this embodiment will be described below with reference to FIGS. 4A to 4E and 5A to 5E. FIGS. 4A to 4E and 5A to 5E are views showing a manufacturing process of the movable plate in the liquid discharge head as shown in FIG. 3, wherein FIGS. 4A to 4E are cross-sectional views of the element substrate taken along the arrangement of a plurality of movable plates, and FIGS. 5A to 5E are cross-sectional views of the element substrate taken along the length of the movable plate. Note that FIGS. 4A to 4E correspond to FIGS. 5A to 5E, respectively.

Figure 4A:
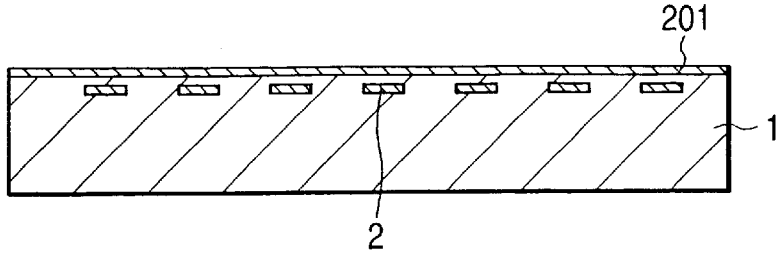
FIGS. 4A, 4B, 4C, 4D and 4E are cross-sectional views of an element substrate taken along the arrangement of a plurality of movable plates.
Figure 5A:
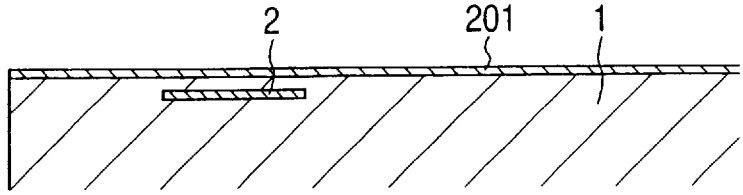
FIGS. 5A, 5B, 5C, 5D and 5E are cross-sectional views of the element substrate taken along the length of movable plate.

Firstly, as shown in FIG. 4A and FIG. 5A, a TiW film 201 as a pad protective layer to protect a pad portion for electrical connection is made about 2000 Å thick all over the element substrate 1 by sputtering.

Figure 4B:
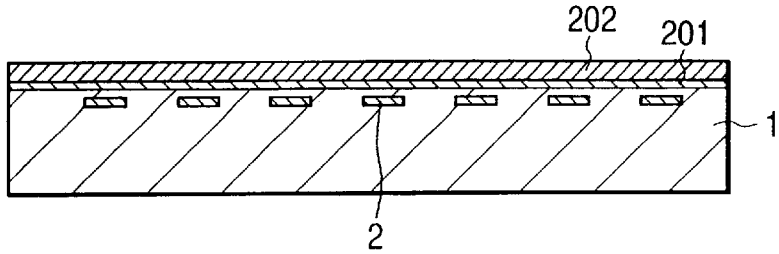
Figure 5B:
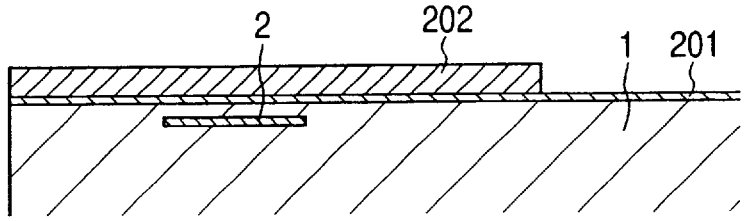

Then, as shown in FIG. 4B and FIG. 5B, an Al film 202 which is a gap formation member between the heat generator 2 and the movable member 31 is made about 5 $\mu$m thick on the TiW film 201 by sputtering, and patterned by well-known photolithography process. Note that the constitutional materials for the gap formation member include aluminum alloys such as Al—Cu, Al—Ni, Al—Cr, Al—Co and Al—Fe, in addition to Al as above mentioned.

Figure 4C:
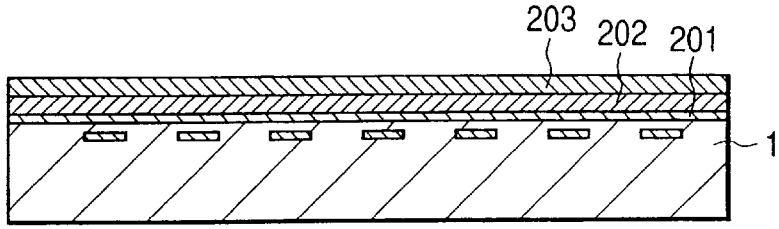
Figure 5C:
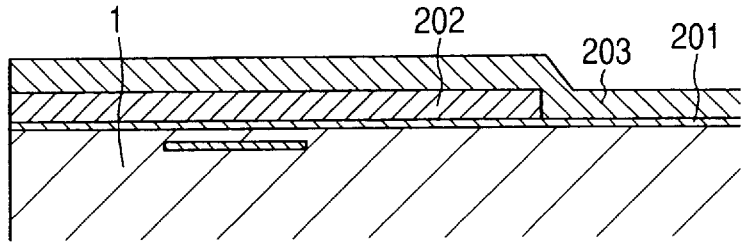

Thereafter, as shown in FIG. 4C and FIG. 5C, an SiN film 203 as a movable plate base portion which is the movable plate 31 is made about 5 pm thick on the Al film 202 and the TiW film 201 by plasma CVD.

Figure 4D:
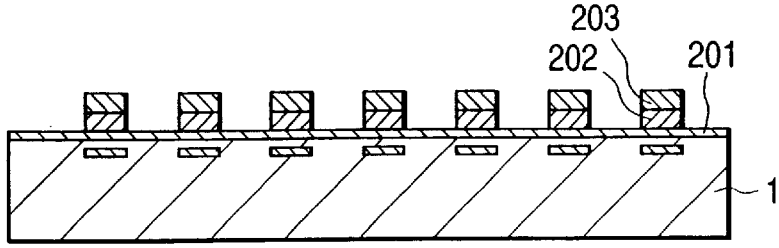
Figure 5D:
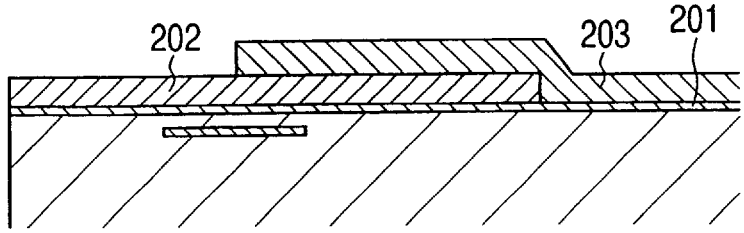

Then, in order to form a comb-tooth shaped movable portion and a support and fixing portion from the SiN film 203, the SiN film 203 is patterned by photolithography process, and etching is performed with the Al film 202 as an etching stop layer, as shown in FIG. 4D and FIG. 5D. Thereby, the element substrate 1 is not etched, but only the SiN film 203 is etched, its comb-tooth portion becoming the movable plate 31.

Figure 4E:
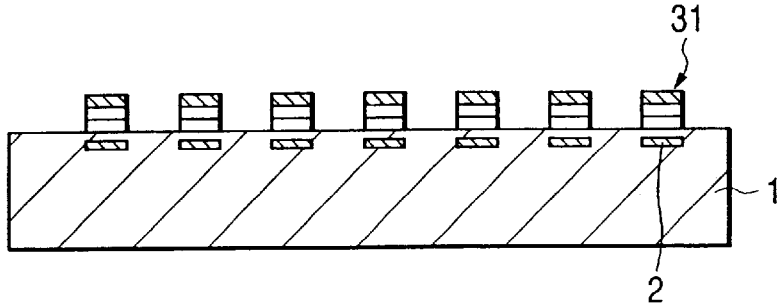
Figure 5E:
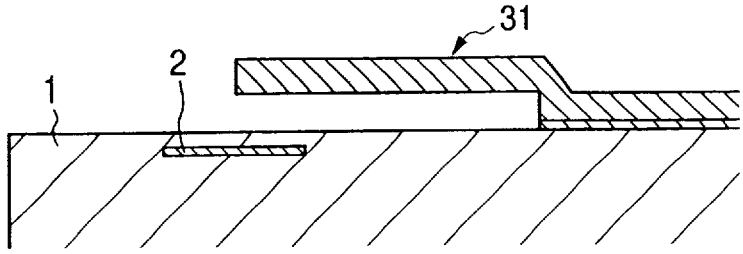

Finally, the Al film 202 is subjected to wet etching, using a mixture liquid of acetic acid, phosphoric acid and nitric acid, and removed, and an exposed portion of the TiW film 201 which is the pad protective layer is removed, using hydrogen peroxide. As a result, as shown in FIG. 4E and FIG. 5E, the movable plate 31 for the liquid discharge head is formed having a step portion as the fixing part to the element substrate 1 and a gap from the heat generator 2 in the movable portion.

Here, in accordance with the present embodiment, the material of each layer that forms the movable members contain the same chemical element to be described later. In the manufacturing process of the movable members, therefore, the etching rate of the releasing solution (the mixed acid of acetic acid, phosphoric acid, and nitric acid for the present embodiment) becomes extremely great (to almost infinity) when removing the Al film serving as the sacrifice layer (gap formation members). As a result, the large-scale production capability is enhanced, and at the same time, the production yield is increased, hence making it easier to provide liquid discharge heads with a smaller product dispersion.

And, after forming the movable plate 31 on the element substrate 1 as above described, the ceiling plate 50 formed with the liquid flow channel 10 and the common liquid chamber 13 is bonded on the element substrate 1, and the orifice plate 51 formed with the discharge opening 18 is also bonded thereto, as shown in FIG. 3, to obtain the liquid discharge head.

Figure 6A:
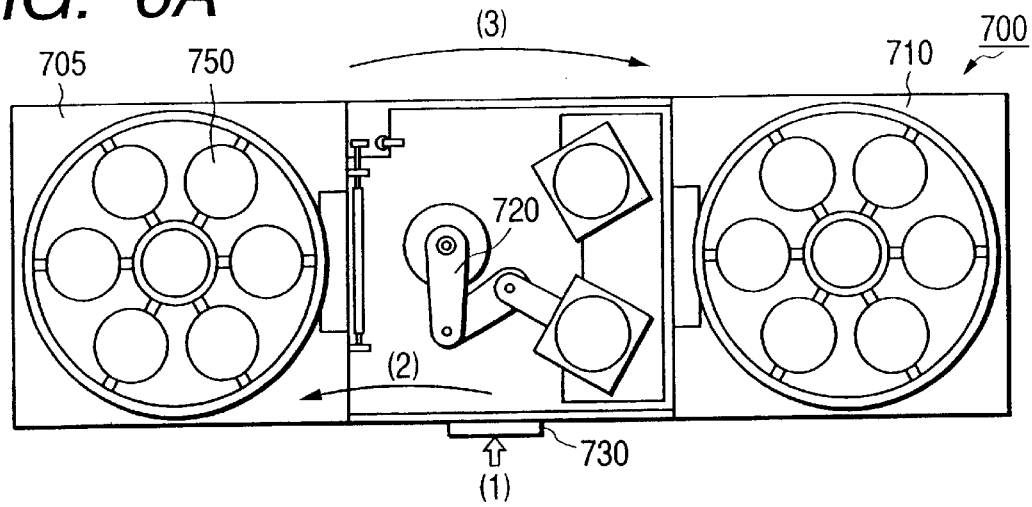
FIGS. 6A, 6B and 6C are typical explanatory views for explaining the film formation process of an SiN film constituting the movable plate in the first embodiment of this invention.
Figure 6B:
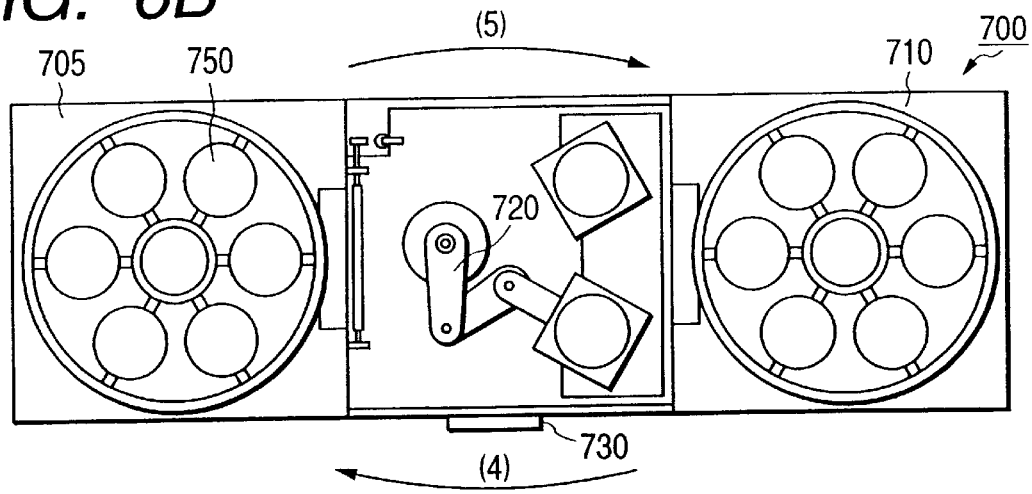
Figure 6C:
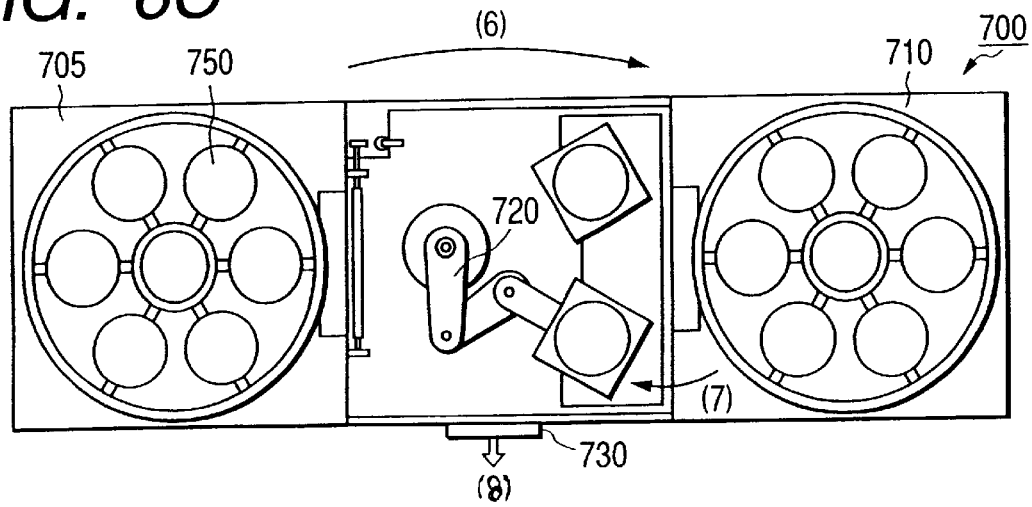

Herein, a film formation process of the SiN film 203 which is the movable plate 6 will be further described in detail with reference to FIGS. 6A to 6C and FIGS. 7A to 7D. FIGS. 6A to 6C are views which schematically illustrate the film formation process of the SiN film for the substrate portion for use of the movable members, which constitutes the movable members. FIGS. 7A to 7D are cross-sectional views which schematically illustrate the principal part of a movable member in the manufacturing process shown in FIGS. 6A to 6C. In this respect, FIGS. 6A to 6C correspond to FIGS. 7A to 7C, respectively.

For the present embodiment, the lamination of the film formation of SiN film 203 is divided and carried out five times by use of the plasma CVD.

Figure 7A:
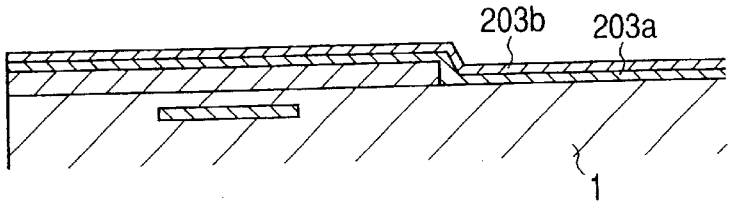
FIGS. 7A, 7B, 7C and 7D are views for explaining the film formation process of an SiN film constituting the movable plate in the first embodiment of this invention, and the movable plate formed after film formation process.

At first, as shown FIG. 6A and FIG. 7A, the elemental substrate 1 having the Al film 202 formed on the surface thereof (which is formed on the wafer 750 in many numbers) is inserted into the insertion inlet 730 of the cassette of the plasma CVD device 700 (see an arrow (1) in FIG. 6A). Then, using the transfer device 720 or the like the elemental substrate 1 is transferred into the first reaction chamber 705 of the plasma CVD device 700 (see an arrow (2) in FIG. 6A). In the reaction chamber 705, the first p-SiN film 203*a* is formed on the elemental substrate 1 in a thickness of approximately 1.0 $\mu$m (see an arrow (3) in FIG. 6A. After that, using the transfer device 720 or the like in the device the elemental substrate 1 is transferred from the first reaction chamber to the second chamber 710 without allowing it to be exposed to the air outside (see the arrow (3) in FIG. 6A). In this reaction chamber 710, the first p-$SiO_2$ film 203*b* is formed on the first p-SiN film 203*a* in a thickness of approximately 0.5 $\mu$m as shown in FIG. 7A.

Then, using transfer means 720 or the like the wafer 750 is transferred again from the second reaction chamber 710 to the first reaction chamber 705 without allowing it to be exposed to the air outside (see an arrow (4) in FIG. 6B), thus forming the first p-SiN film 203*a* in a thickness of approximately 1.0 $\mu$m. After that, in the same process as shown in FIG. 7A, the wafer 750 is transferred again by use of the transfer means 720 or the like from the first reaction chamber 705 to the second reaction chamber 710 without allowing it to be exposed to the air outside (see an arrow (5) in FIG. 6B). The same film formation process is repeated, and as shown in FIG. 7B, the second p-SiN film 203*c* and the second p-$SiO_2$ film 203*d* are formed on the first p-$SiO_2$ film 203*b*.

Lastly, again using transfer means 720 or the like the wafer 750 is again transferred from the second reaction chamber 710 to the first reaction chamber 705 without touching it (see an arrow (6) in FIG. 6C). When the third p-SiN film 203*e* is formed on the second p-$SiO_2$ film 203*d*, the SiN film 203 is formed in a five-layer structure as shown in FIG. 7C. After that, the wafer 750 having the elemental substrate 1 is withdrawn from the first reaction chamber 705 by use of the transfer means 720 (see an arrow (7) in FIG. 6C), and then, it is withdrawn from the cassette insertion inlet 730 of the plasma CVD apparatus 700 (see the arrow (1) in FIG. 6A).

By layering the SiN film having a relatively high Young's modulus and forming the $SiO_2$ film having a relatively low Young's modulus between the SiN films, as above described, the grain growth within the SiN film can be suppressed to cut off linkage of the grain boundaries, resulting in the increased allowance for flexibility of the movable portion accompanied with the displacement of the movable plate, the movable plate having greater strength and more durability. Note that the materials having a relatively high Young's modulus may include silicon carbide, in addition to SiN as above cited.

Figure 7B:
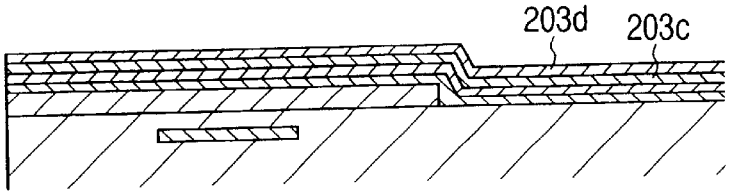
Figure 7C:
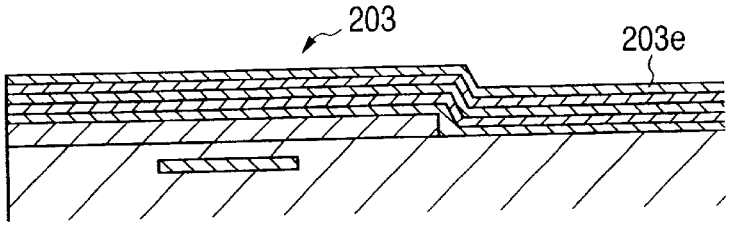
Figure 7D:
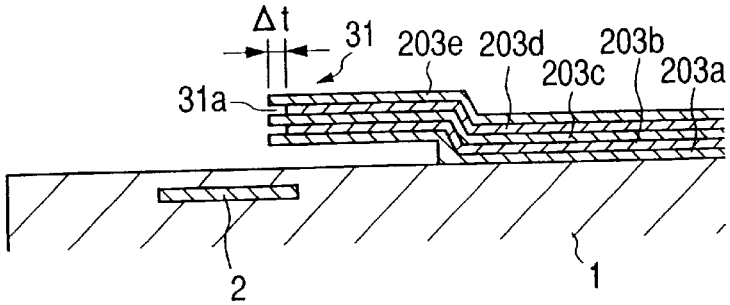

FIG. 7D is a cross-sectional view schematically showing the movable member formed by etching the SiN film 203 and removing the Al film 202 on the elemental substrate 1 after the formation process shown in FIG. 7A to 7C. Here, when etching the SiN film 203 and removing the Al film 202 on the elemental substrate 1, the outer peripheral portion 31*a* of the movable member 31 is configured in the form of saw teeth as shown in FIG. 7D due to the etching rate between the SiN film and $SiO_2$ film by use of the etching gas and etching solution. Here, since FIG. 7D is a cross-sectional view, the saw teeth portion is represented only on the free end side of the movable member. In accordance with the present embodiment, the etching rate of the SiN film and $SiO_2$ film is approximately 1:2 against the etching gas. Therefore, as shown in FIG. 7D, $SiO_2$ film forms the recessed portion with respect to the SiN film. In accordance with the present embodiment, the depth $\Delta t$ thereof is $\Delta t$=approximately 1.0 $\mu$m.

As described above, in accordance with the present embodiment, the sectional area orthogonal to the thickness direction of the movable member and the length of the outer circumference of the movable member are allowed to change from the large (the first p-SiN film) to the small (the first p-$SiO_2$ film) to the large (the second p-SiN film) to the small (the second p-$SiO_2$ film) to the large (the third p-SiN film). (In the specification hereof, the configuration in which the sectional area orthogonal to the thickness direction of the movable member and the length of the outer are caused to change in this manner is expressed as "to be in the form of saw teeth in the thickness direction".)

With the formation of such saw teeth as this, turbulence occurs due to the outer peripheral end face of the saw teeth shape when the movable member is displaced by the development and extinction of the bubble created by the heat generating element. As a result, the ultrafine bubbles that may reside in the liquid flow path and the common liquid chamber are discharged through the discharge port, thus acting to suppress the movement thereof toward the common liquid chamber side.

Further, with the saw teeth formation on the outer circumference of the movable member as in the present embodiment, the bending robustness and twisting robustness are increased in the direction of free end of the flat plate type movable member which presents the same thickness. As a result, the movable member whose outer circumference is formed in the saw teeth can be made thinner than the movable member formed by the flat plate having the same robustness, and advantageously, it has excellent hydraulic power. In other words, with the formation of such saw teeth as described here, it becomes easier for the leading end portion of the movable member to be more supple than other portions when ink flows in the nozzle by the development and extinction of the bubble created by the heat generating element. Therefore, the response of the movable member becomes faster when being displaced vertically to make the resultant speed of ink faster in returning to the nozzle leading end and onto the heat generating element as well.

In order to form the outer circumference in the saw teeth, the material of each layer should only be in combination so as to create the difference in etching rate with respect to the fluorine gas in the dry etching process using the fluorine gas or the like, for example. As the combination with SiN, it may be possible to use SiC, amorphous silicon, SiGe, SiO, or the like.

In accordance with the present embodiment, allowance is increased as to the suppleness of the movable portion (particularly, the fulcrum) along with the displacement of the movable member so as to enhance the strength of the movable member, hence making it possible to improve the durability of the movable member.

While the SiN film 203 is constructed of five layers in the above example, it should be understood that the SiN film may not be necessarily a five-layer structure in order to obtain such effect.

For example, between two-layered SiN film layers, there is provided at least a three-layered structure which is made by the $SiO_2$ film layer formed with different Young's modulus from those SiN films, or the like, or it should be good enough if only the structure is formed in lamination of three layers or more each having different Young's modulus from the adjacent area. In this case, the SiN film is formed in a thickness of approximately 5 $\mu$m.

In the respect, the aforesaid effect is obtainable by use of some other metal, but not necessarily a material that contains silicon as in the present embodiment. However, with the same chemical element in each of the layers as the present embodiment, it becomes possible to enhance the close contact of layers themselves, respectively. This arrangement of the same chemical element is more desirable, because then there is no fear that the layers may be peeled off from each other while the movable member is in use. Also, as a more desirable mode, the movable member should be structured so that the layer, which is formed by the material having a comparatively low Young's modulus, is placed between the layers formed by the material having a comparatively high Young's modulus.

Second Embodiment

Figure 8:
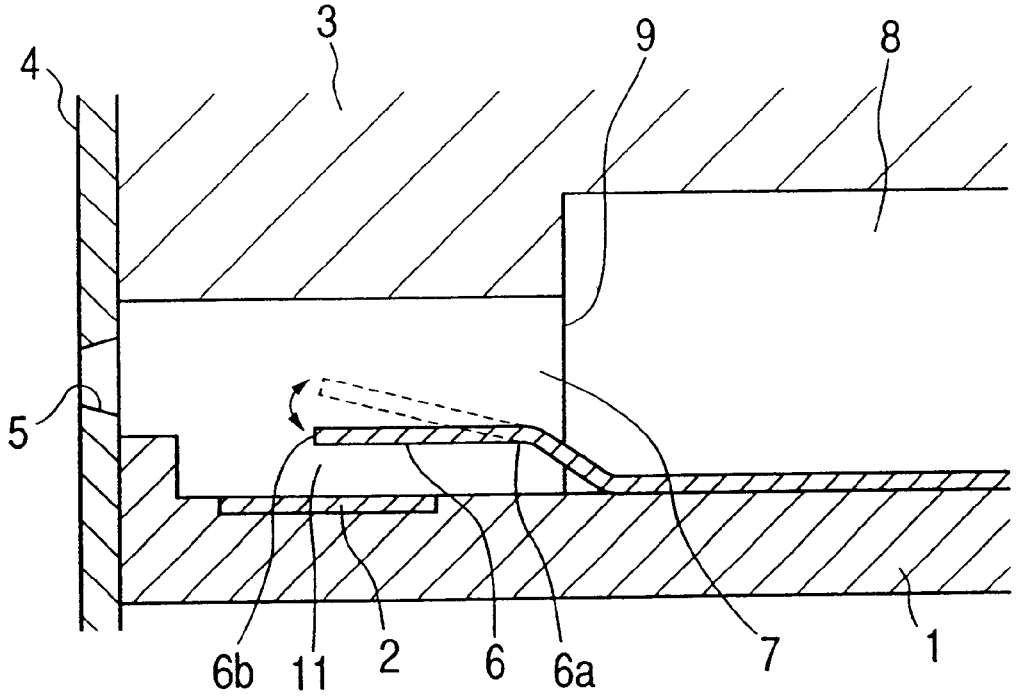
FIG. 8 is a cross-sectional view of the liquid discharge head in a second embodiment of the present invention, taken in the liquid flow direction.

FIG. 8 is a cross-sectional view of the second embodiment of a liquid discharge head according to the present invention taken in the liquid flow direction.

As shown in FIG. 8, this liquid discharge head has an element substrate 1 on which a plurality of heat generators 2 (only one is shown in FIG. 8) for generating heat energy to produce a bubble in the liquid are arranged in parallel, a ceiling plate 3 bonded on this element substrate 1, and an orifice plate 4 which is bonded on the front end faces of the element substrate 1 and the ceiling plate 3. The element substrate 1 is one in which a silicon oxide film or silicon nitride film is made on the substrate made of silicon, for the purposes of insulation and heat reservation, and an electrical resistive layer and a wiring electrode which constitute a heat generator 2 is patterned thereon. More particularly, it has the structure as shown in FIG. 1, the heat acting portion 108 of FIG. 1 corresponding to the heat generator 2. A voltage is applied from this wiring electrode to the electrical resistive layer, to pass a current through the electrical resistive layer so that the heat generator 2 generates the heat.

The ceiling plate 3 constitutes a plurality of liquid flow channels 7 corresponding to the heat generators 2 and a common liquid chamber 8 for supplying the liquid to each liquid flow channel 7, and is integrally provided with a flow passage side wall 9 extending from the ceiling plate portion to each heat generator 2. The ceiling plate 3 which is made of silicon-type material can be formed by etching a portion of the liquid flow channel 7, after forming the pattern of the common liquid chamber 9 by etching, and depositing a material such as silicon nitride or silicon oxide for the flow passage side wall 9 on the silicon substrate by a well-known film formation method such as CVD.

The orifice plate 4 is formed with a plurality of discharge openings 5, each of which corresponds to each liquid flow channel 7, and communicates to the common liquid chamber 8 via the liquid flow channel 7. The orifice plate 4 which is also made of silicon-type material can be made by, for example, planing a silicon substrate formed with the discharge openings 5 in a thickness of about 10 to 150 $\mu$m. Note that the orifice plate 4 does not have to be required for the present invention, but instead of providing the orifice plate 4, the ceiling plate with the discharge openings can be provided in such a way as to leave behind a wall corresponding to the thickness of the orifice plate 4 at a top end face of the ceiling plate 3, in forming the liquid flow passages 7 on the ceiling plate 3, and form the discharge openings 5 through this wall.

Further, this liquid discharge head is provided with a cantilevered movable plate 6 disposed facing the heat generator 2 and directly fixed onto the element substrate 1. The movable plate 6 is a thin film made of silicon-type material such as silicon nitride, silicon oxide or silicon carbide.

This movable plate 6 is supported and fixed onto the element substrate 1, upstream in the main flow passing from the common liquid chamber 8 via above the movable plate 6 to the discharge opening 5, to constitute a fulcrum 6*a*. Further, a free end 6*b* is disposed at a position facing the heat generator 2 and centrally thereof, with a predetermined distance away from the heat generator 2, to have the free end 6*b* downstream from this fulcrum 6*a*. The movable plate 6 of this embodiment has a curved-face portion around the fulcrum 6*a*. A bubble producing region 11 is provided between this heat generator 2 and the movable plate 6.

Based on the above constitution, if the heat generator 2 is heated, the liquid in the bubble producing region 11 between the movable plate 6 and the heat generator 2 is subjected to heat, so that a bubble is produced and grown on the heat generator 2, owing to film boiling phenomenon. A pressure caused by the growth of this bubble acts predominantly on the movable plate 6, the free end 6*b* of the movable plate 6 being displaced around the fulcrum 6*a* to be widely open toward the discharge opening 5, as indicated by the broken line in FIG. 8. Owing to the displacement of the movable plate 6, or its displaced state, the propagation of the pressure caused by produced bubble or the growth of bubble itself can be led toward the discharge opening 5, so that the liquid is discharged from the discharge opening 5.

That is, by providing the movable plate 6 having the fulcrum 6*a* upstream (on the side of common liquid chamber 8) in the flow of liquid within the liquid flow channel 7 on the bubble producing region 11 and the free end 6*b* downstream (on the side of discharge opening 5), the bubble pressure propagation can be led downstream, so that bubble pressure can contribute to discharging directly and efficiently. And the bubble growth direction itself is also led downstream, like the pressure propagation direction, so that the bubble is grown more greatly downstream than upstream. In this way, the radical discharge characteristics such as discharge efficiency, discharge power or discharge rate can be improved by controlling the bubble growth direction itself by the movable plate, and controlling the bubble pressure propagation direction.

On the other hand, if the bubble enters a defoaming process, the bubble rapidly defoams due to synergistic effect with an elastic force of the movable plate 6, and the movable plate 6 finally returns to its initial position as indicated by the solid line in FIGS. 7A to 7D. At this time, the liquid is flown in from upstream or the common liquid chamber 8 to refill the liquid into the liquid flow passage 7 to compensate for the contracted volume of bubble in the bubble producing region 11, and compensate for the volume of discharge liquid, this refilling of liquid can be made efficiently, reasonably and stably, along with the return action of the movable plate 6.

The movable plate of the liquid discharge head as above described is manufactured through the manufacturing processes as shown in FIGS. 4A to 4E and 5A to 5E, basically in the same way as the first embodiment.

Thus, a film formation process for the SiN film 203 which becomes the movable plate, which is manufactured by a different method from the first embodiment, will be illustrated in detail with reference to FIGS. 9A to 9C, and FIGS. 10A to 10H.

In this embodiment, the film formation and layering of SiN film 203 was made three times by plasma CVD.

Figure 9A:
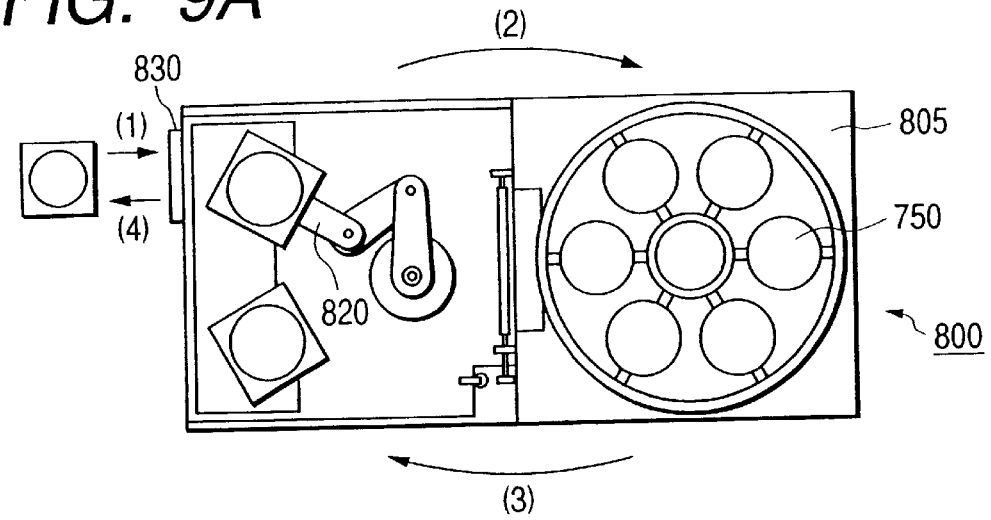
FIGS. 9A, 9B and 9C are typical explanatory views for explaining the film formation process of an SiN film constituting the movable plate in the second embodiment of this invention.
Figure 9B:
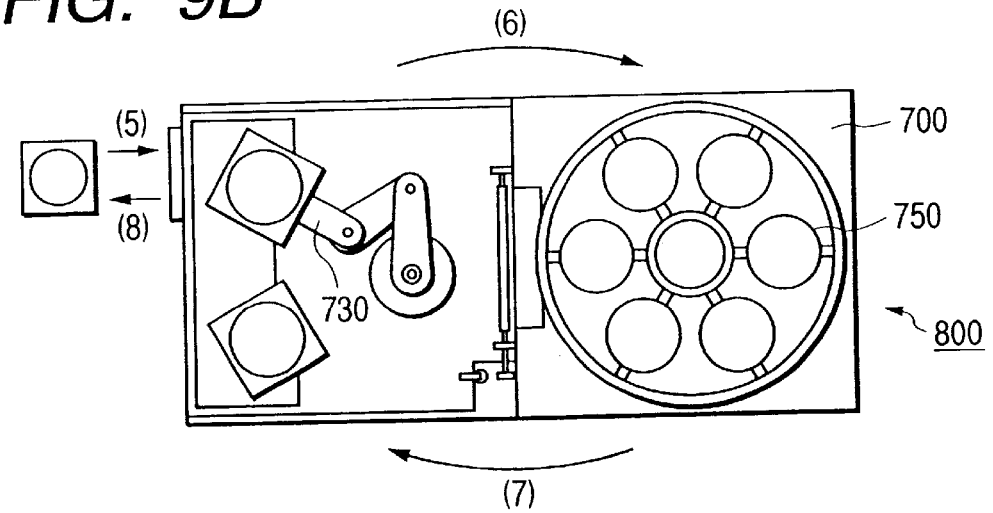
Figure 10A:
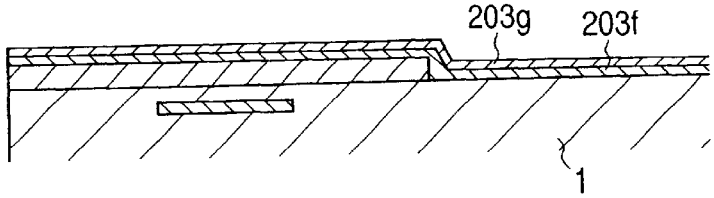
FIGS. 10A, 10B, 10C, 10D, 10E, 10F, 10G and 10H are views for explaining the film formation process of an SiN film constituting the movable plate in the second embodiment of this invention, and the movable plate formed after film formation process.

At first, as shown in FIG. 9A, the wafer 750 having many numbers of the elemental substrates 1 on it is inserted into the cassette insertion inlet 830 of the plasma CVD apparatus 800 (see an arrow (1) in FIG. 9A). Then, the wafer 750 is carried into the reaction chamber 805 of the CVD apparatus 800 by use of the transfer device 820 or the like (see an arrow (2) in FIG. 9A), thus forming the first p-SiN film 203*f* in a film thickness of approximately 1.6 $\mu$m. After that, the wafer 750 is withdrawn from the reaction chamber 805 of the CVD apparatus by use of the transfer device 820 or the like (see an arrow (3) in FIG. 9A), and then, withdrawn from the cassette outlet to be left intact in the air outside (see an arrow (4) in FIG. 9A), thus forming the first oxide film 203*g*. Thus, as shown in FIG. 10A, the two-layered film is formed.

Figure 10B:
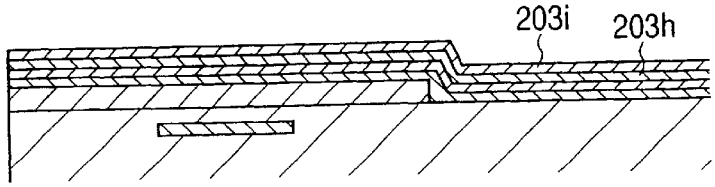

Then, as shown in FIG. 9B, the wafer 750 is again inserted into the cassette inlet 830 of the plasma CVD apparatus 800 (see an arrow (5) in FIG. 9B). After that, using the transfer device 920 or the like the wafer is placed in the reaction chamber 805 of the CVD apparatus 800 (see an arrow (6) in FIG. 9B). Thus, as shown in FIG. 10B, the second p-SiN film 203*h* is formed in a film thickness of approximately 1.6 $\mu$m. After that, in the same manner as in FIG. 9A, the wafer 750 is withdrawn from the reaction chamber 805 of the CVD apparatus by use of the transfer device 820 (see arrow (7) in FIG. 9B), and withdrawn from the cassette outlet to be left intact in the air outside (see arrow (8) in FIG. 9B), hence forming the second oxide film 203i on the surface.

Figure 9C:
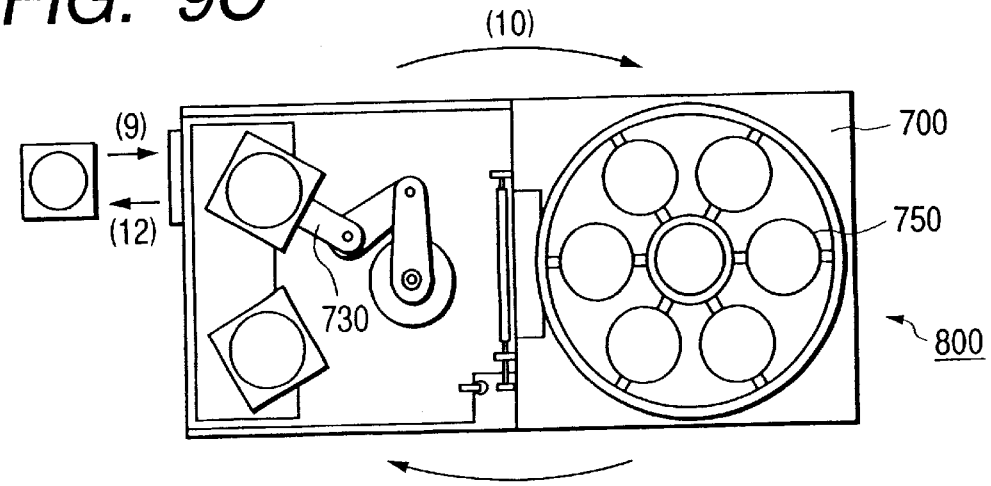
Figure 10C:
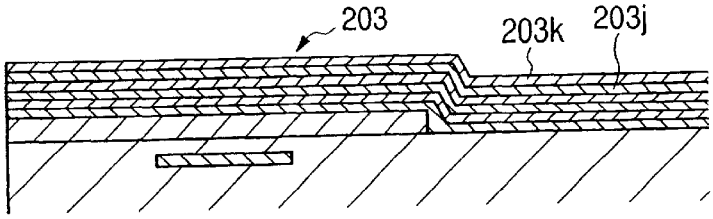
Figure 10D:
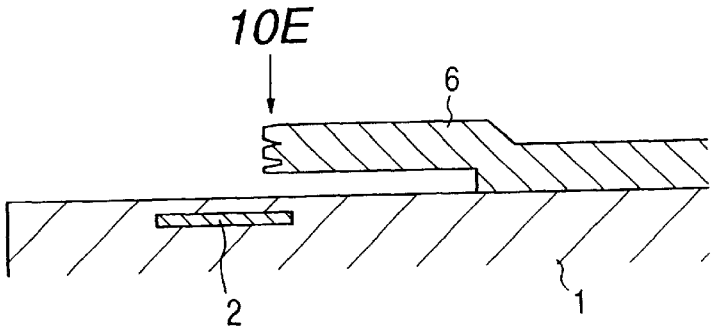
Figure 10E:
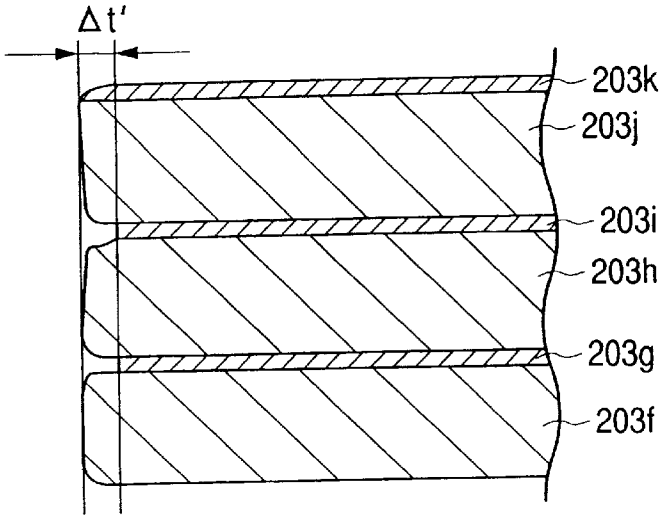

Further on this film, the same process is repeated (see arrows (9) to (12) in FIG. 9C). Then, as shown in FIG. 10C, the third p-SiN film 203*j* and the third oxide film 203*k* are formed in a thickness of approximately 1.6 $\mu$m. Thereby, the SiN film 203 having a thickness of about 5 $\mu$m as a whole is formed.

In this way, by layering the SiN film 203 several times and forming an oxide film layer therebetween, the grain growth is suppressed to cut off linkage of the grain boundaries, like the first embodiment. Thereby, the strength of the fulcrum portion of the movable plate 6 is increased, and the durability of the movable plate 6 is improved. Also, due to greater durability of the movable plate 6, the movable plate 6 can work stably over the long period, and consequently the discharge characteristics become stable over the long period to obtain the liquid discharge head which is highly reliable.

Also, as shown in FIGS. 9A to 9C and 10A to 10H, when layering the SiN film 203 several times, as shown in, in the etching process of the SiN film 203 (see FIG. 4D and FIG. 5D) and the removal process of the Al film 202 (see FIG. 4E and FIG. 5E) which are performed thereafter, the selection ratio between the SiN film 203*f*, 203*h*, 203*j* and the oxide films 203*g*, 203*i*, 203*k* occurs by an etching gas and an etching liquid, so that the peripheral end face of the movable plate 6 is made like a saw-tooth in a thickness direction of the movable plate 6, as shown in FIG. 8D. In the case of the present embodiment, the oxide film is formed in the recessed shape which is depressed by $\Delta t'$ with respect to the SiN film as clear from the enlarged view of the free end portion of the movable member at FIG. 8D shown in FIG. 8E. The effect that can be produced is the same as the case of the first embodiment.

Figure 10F:
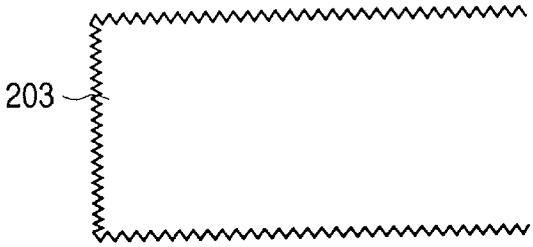

Also, for the SiN film 203 etching process or the like described above, the description has been made of the movable member which presents the saw teeth in the thickness direction thereof. In practice, in the direction intersecting the thickness direction, too, the movable member presents smaller saw teeth than the saw teeth in the thickness direction in a size which may be observed by SEM or the like. In other words, as shown in FIG. 10F which is a partially enlarged schematic view of FIG. 10D in the direction indicated by arrow A, the outer circumference of an arbitrary section of the movable member, which is orthogonal to the thickness direction thereof, presents fine irregular portion.

With the provision of such structure, an ink layer resides in a small gap between the nozzle side walls and the movable member. The ink layer is effective in controlling the vertical displacement of the movable member so as not to be greatly suppressed when the movable member is displaced by the ink flow in the nozzle occurring by the development and extinction of the bubble created by the heat generating element.

Figure 10G:
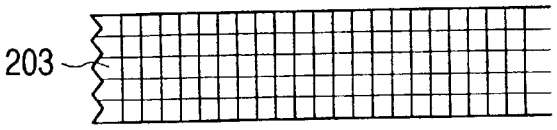
Figure 10H:
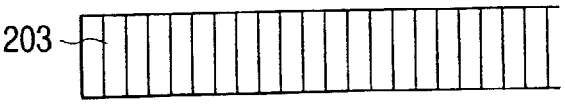

In this respect, when a plurality of layers are laminated in the cases of the first embodiment, the present embodiment, and the like, the saw teeth are formed on the movable member both in the thickness direction thereof, and in the direction intersecting the thickness direction thereof eventually as shown in the schematic view of the side face portion of the movable member represented in FIG. 10G. With this condition, the hydromechanic properties of the movable member against ink are made synergically superior.

In this respect, the formation of the saw teeth of the movable member in the direction intersecting the thickness direction thereof may be effectuated positively by the utilization of mask which is used when the film that forms the corner members is patterned. However, when the film of 1 to 10 $\mu$m thick is etched, the mask material is subjected to the reverse sputtering due to the etching gas or the like. Then, the particles thus produced may adhere to the side walls of the film to be etched. As a result, an effect is produced such as to shield the radical seed which derives from the etching gas, among some others. Thus, saw teeth grooves are naturally formed, and then, there is no need for the film lamination to form the movable member as to the saw teeth configuration in the direction intersecting the thickness direction of the movable member. As shown in the schematic view of the side face portion of the movable member represented in FIG. 10H, this configuration is possible even for the single layer arrangement.

Third Embodiment

FIGS. 11A to 11E are cross-sectional views showing a second embodiment involving a manufacturing method of the movable plate for the liquid discharge head as shown in FIG. 3. This embodiment is characterized by providing a plate base 204 on the element substrate 1 to which the movable plate 31 is fixed.

Figure 11A:
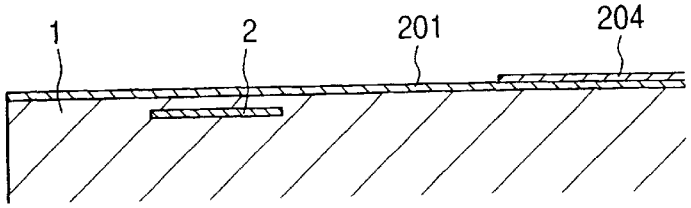
FIGS. 11A, 11B, 11C, 11D and 11E are views-showing a third embodiment of a manufacturing method for the movable plate of the liquid discharge head as shown in FIG. 3.
Figure 11B:
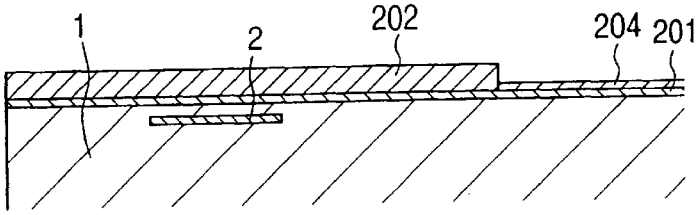
Figure 11C:
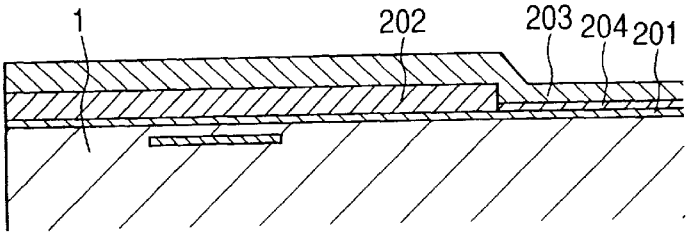

Firstly, the plate base 204 made of a Ti or Ta containing material and having the effect of relieving the stress on the SiN film 203 as a movable plate base portion constituting the movable plate 31 and enhancing adhesion of the SiN film 203 is patterned on a portion of the element substrate to which the movable plate 31 is fixed (FIG. 11A). Thereafter, the Al film 202 that is a gap formation member is made on the element substrate 1 and the plate base 204, and patterned (FIG. 11B).

Figure 11D:
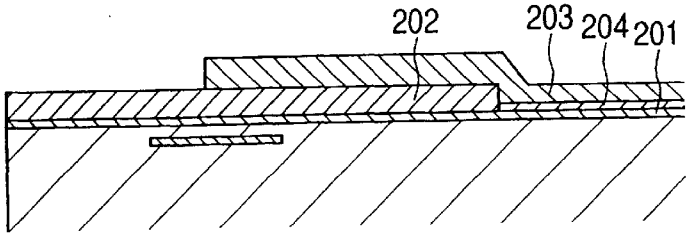

Subsequently, the SiN film 203 which becomes the movable plate 31 is made on the Al film 202 and the plate base 204 by plasma CVD (FIG. 11C), and patterned, and then the etching is performed using the Al film 202 as an etching stop layer (FIG. 11D).

Figure 11E:
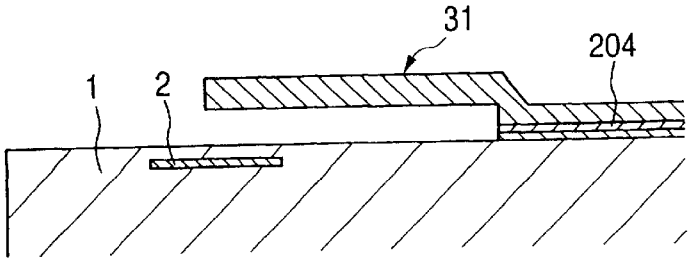

Finally, the Al film 202 is subjected to wet etching, using a mixture of acetic acid, phosphoric acid and nitric acid, and removed, and an exposed portion of the TiW film 201 which is a pad protective layer is removed using hydrogen peroxide, whereby the movable plate 31 is formed on the plate base 204, as shown in FIG. 11E.

As above described, by providing the plate base 204 on the portion of the element substrate 1 to which the movable plate 31 is fixed, the strength of connecting the support and fixing portion of the movable plate 31 with the element substrate 1 is increased, and the mechanical durability of the movable plate 31 is further improved.

Figure 12:
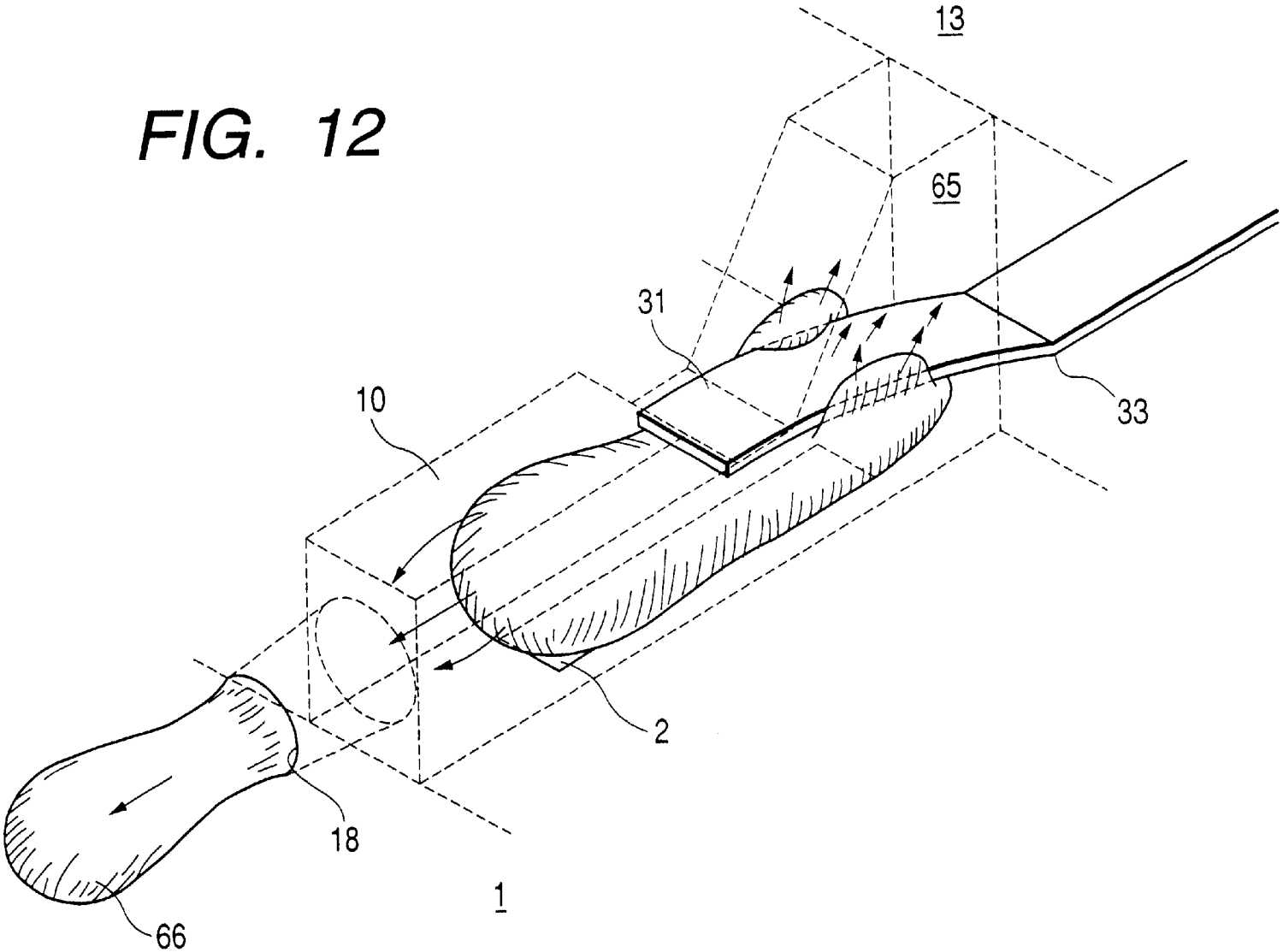
FIG. 12 is a perspective view showing a part of the liquid discharge head in the third embodiment of this invention.
Figure 13:
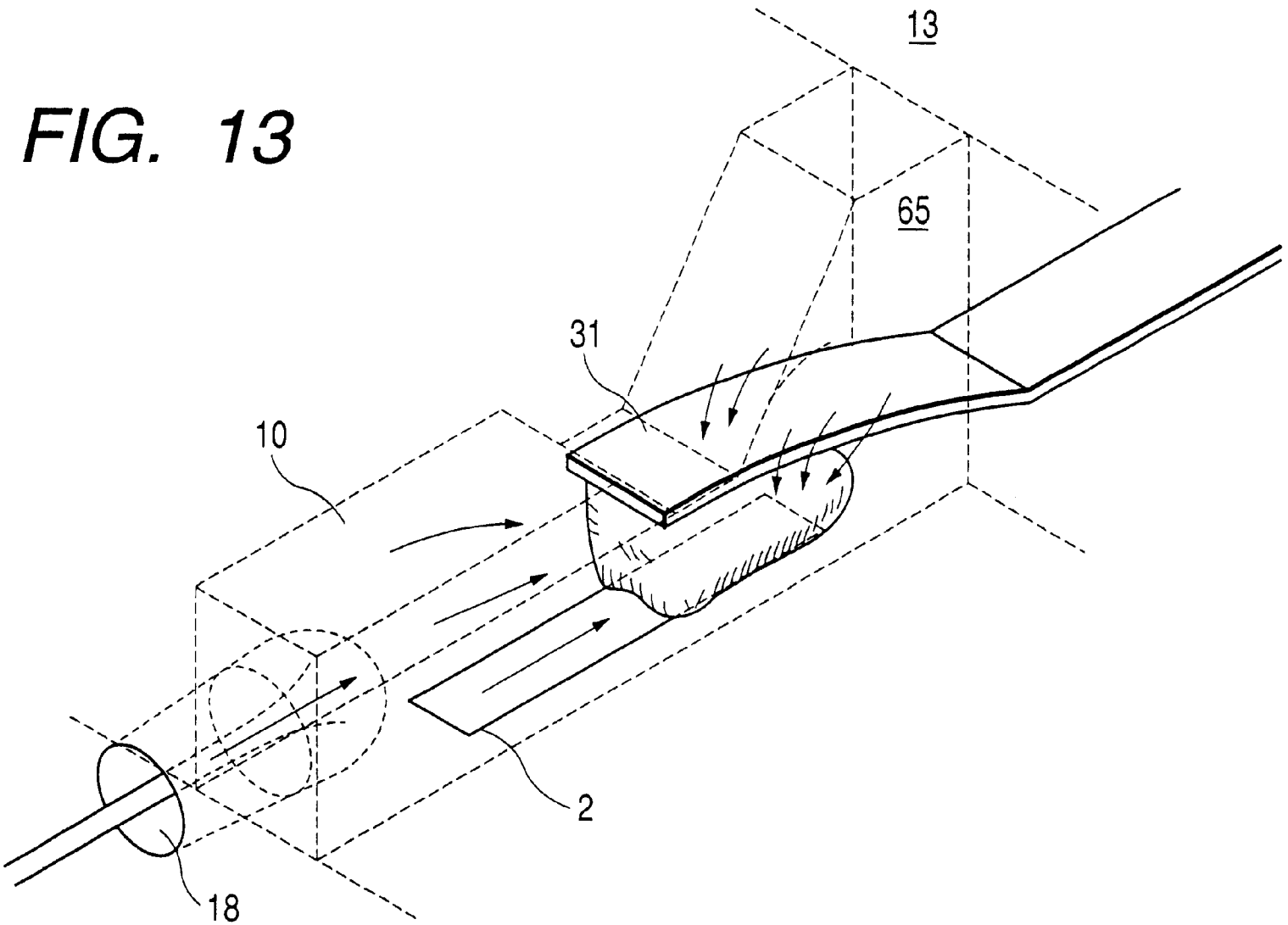
FIG. 13 is a perspective view showing a part of the liquid discharge head in the third embodiment of this invention.

FIGS. 12 and 13 are perspective views partly showing the liquid discharge head of this embodiment.

The movable plate for the liquid discharge head adopted in this invention can have its increased strength, when it is flexed greatly with the bubble produced, as shown in FIGS. 12 and 13. Further, it can fully cope with the strength for the fulcrum 33 to support the movable plate 31, when flexed greatly.

And, after forming the movable plate on the liquid discharge head, the discharge opening 18 for discharging the ink as shown in FIG. 13 is formed to constitute the liquid discharge head.

Fourth Embodiment

In accordance with each of the embodiments described above, the layer for the formation of the movable member uses different materials, such as SiN film and $SiO_2$ film, and SiN film and the oxide film thereof. For the "layers" of the present invention, however, the materials are not necessarily different from each other. Also, in accordance with each of the embodiments described above, the manufacturing process is discontinuous between the end time of each film formation process and the starting time of the next film formation due to the transfer process needed between them, or the like. The one-time film formation of the present invention is not necessarily divided by time. Therefore, in accordance with the present embodiment, the detailed description will be made of the lamination structure formed by one and the same material in conjunction with FIGS. 14A to 14C, and FIGS. 15A to 15C.

Figure 14A:
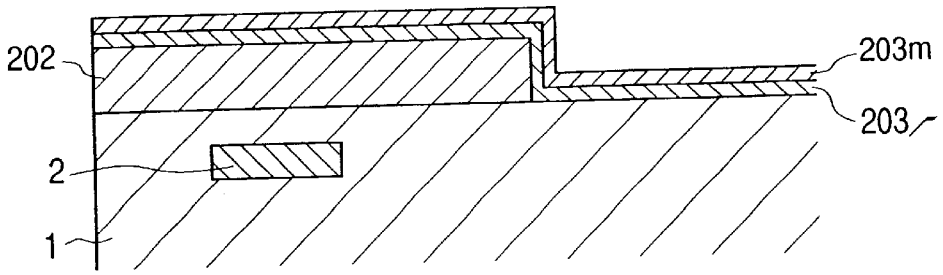
FIGS. 14A, 14B and 14C are typical explanatory views for explaining the film formation process of an SiN film constituting the movable plate in a fourth embodiment of this invention.
Figure 14B:
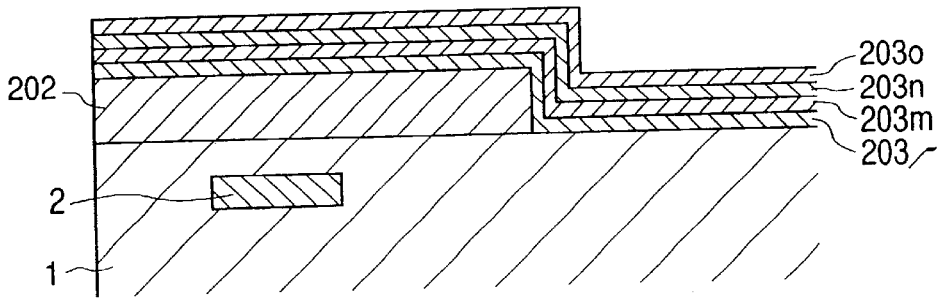
Figure 14C:
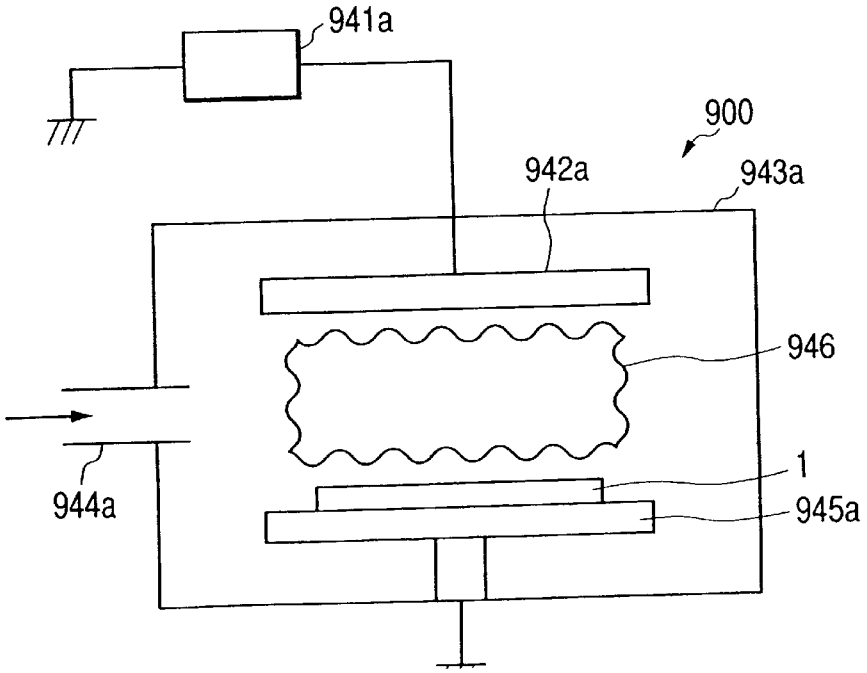

FIGS. 14A and 14B are cross-sectional views which schematically illustrate the principal part of the movable member in the manufacturing process of the movable member in accordance with a fourth embodiment of the present invention. Here, for the present embodiment, it is possible to apply each of the embodiments described above to the structure of the entire body of the recording head. Therefore, the detailed description thereof will be omitted. Also, FIG. 14C is a view which illustrates the outline of the CVD apparatus used for the fourth embodiment of the present invention. In FIG. 14C, the RF electrodes 942*a* and the stage 945*a*, which face each other with a specific distance in the reaction chamber 943*a* of the plasma CVD apparatus for the formation of the SiN film 203. To the RF electrodes 942*a*, voltage is applied from the RF supply source 941*a* outside the reaction chamber 943*a*. On the other hand, the elemental substrate 1 is installed on the surface of the stage 945*a* on the RF electrodes 942*a* side. Thus, the elemental substrate 1 on the heat generating 2 side faces the RF electrodes 942*a*. Here, the Ta cavitation proof film provided for the elemental substrate 1, which is formed on the surface of the heat generating element 2, is electrically connected with the silicon substrate of the elemental substrate 1. Then, the gap formation member 202 is grounded through the silicon substrate of the elemental substrate 1 and the stage 945*a*. For the plasma CVD apparatus thus structured, gas is supplied to the reaction chamber 943*a* by way of the supply tube 944*a* while the cavitation proof film is grounded, thus generating plasma 946 between the elemental substrate 1 and the RF electrodes 942*a*. The ion seed and radical decomposed by the plasma discharges in the reaction chamber 943*a* are deposited on the elemental substrate 1, and the SiN film 203 is formed on the elemental substrate 1. At this juncture, a load is generated on the elemental substrate 1 by the ion seed and radical, but with the cavitation proof film being grounded, it is possible to prevent the heat generating elements 2, the latch circuits, and other functional elements on the elemental substrate 1 from being damaged by the loads of ion seed and radical.

Figure 15A:
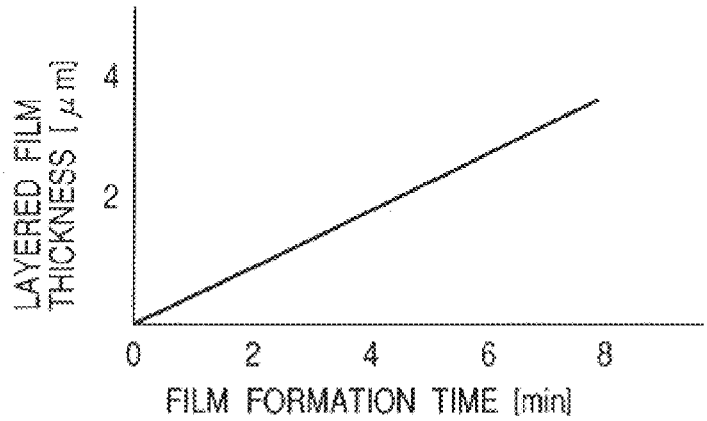
FIGS. 15A, 15B and 15C are explanatory views on the film formation process of an SiN film constituting the movable plate in the fourth embodiment of this invention.
Figure 15B:
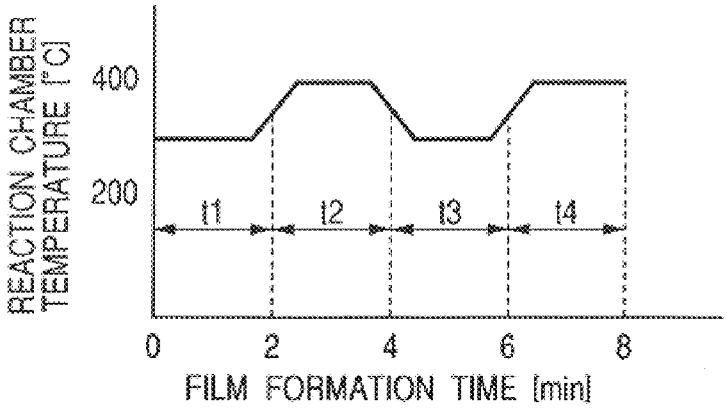

Now, in accordance with the present embodiment, the lamination temperature is, at first, gradually raised in the reaction chamber 943*a* shown in FIG. 14C from approximately 300° C. at the initiation of film lamination and in the initial stage of the development then, when the film lamination temperature arrives at approximately 400° C., the lamination temperature is kept constantly (see FIG. 15B). During this period, as shown in FIG. 15A, the film thickness is increased almost specifically. However, the quality of the film formed at the lamination temperature of approximately 300° C. (the film formed at t1 in FIG. 15B) has a lower density than the quality of film (formed at t2 in FIG. 15B) which is formed at the lamination temperature of approximately 400° C. As a result, the first SiN film dense portion 203*m* is formed on the first SiN film sparse portion 203*l* as shown in FIG. 14A.

Subsequently, as shown in FIG. 15B, the lamination temperature is again reduced gradually to approximately 300° C., and when the lamination temperature reaches approximately 300° C., it is kept constantly, and then, the lamination temperature is again raised gradually to approximately 400° C. In this manner, as shown in FIG. 14B, the sparse portion 203*n* of the second SiN film (formed at t3 in FIG. 15B) and the dense portion 203*o* of the second SiN film (formed at t4 in FIG. 15B) are produced.

A change of film qualities of the kind is related to the etching rate. The etching rate is faster on the portions (203*l* and 203*n*) where the film quality is in the sparse condition than on the dense portions (203*m* and 203*o*). Therefore, the-section of the formed movable member becomes in the saw teeth configuration in the thickness direction almost as in the first embodiment and others.

Also, as compared with the dense portions (203*m* and 203*o*), the Young's modulus of the portions (203*l* and 203*n*) of the sparse film quality is also different. Therefore, as described in each of the embodiments, with the increased allowance of the suppleness of movable portion along with the displacement of the movable member, the strength of the movable member is improved, hence making it possible to enhance the durability of the movable member. Thus, the "layer" of the present invention is defined as the one having its density and composition which differ from those of the adjacent layer. For the described above, the layers are in the four-layered structure.

Figure 15C:
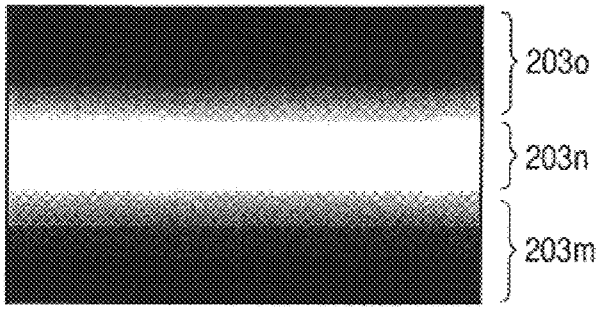

In this respect, although it may be possible to set the definite separation with the adjacent layer between each of the layers, there are the cases where no definite separation with the adjacent layer in practice as shown in FIG. 15C particularly when the mode is such that the sparse and dense conditions are changeable as in the present embodiment. FIG. 15C is a schematic view which shows the section of the movable member in which the dense portion of the material is represented darker. If the boundary regions are not distinct as in this example, and then, the density of the material changes from dense to dense through sparse gradually, it should be good enough to define the region which is relatively dense with respect to the adjacent portion and the region which is relatively sparse thereto as each of the "layers". Therefore, it is to be understood that the layer which is not definitely separated from the adjacent layer as in this embodiment is also included in the "layer" definition of the present invention.

Also, in accordance with the embodiment described above, the ending time of the first film formation process and the starting time of the second film formation process is continuous. However, in this embodiment, too, the grain development is blocked between the SiN films (203*l* and 203*m*) produced in the first film formation process and the SiN film (203*l* and 203*m*) produced in the second film formation process as in the first to third embodiments described earlier, and the grain boundaries are cut off. In this manner, the strength of the fulcrum of the movable member is enhanced to improve the durability of the movable member eventually.

Also, with the improved durability of the movable member, it can operated stably for a longer period of time. As a result, the discharge characteristics are stabilized for a long time, hence obtaining a highly reliable liquid discharge head.

As described above, the one-time film formation process of the present invention may be defined even when the film formation process is arranged in such a manner that the film formed in each of the processes on the substrate side has different density, composition, or the like from those on the side opposite to that side.

Fifth Embodiment

FIGS. 16A to 16E are views which illustrate a fifth embodiment in accordance with the present invention. Unlike the first to fourth embodiments described above, the present embodiment is not intended to disclose the movable member in the laminated structure of 3 layers or more each having different Young's modulus from the adjacent layer each other or the movable member produced in the film formation process performed at least in two time or more. Nevertheless, with this embodiment, it is made possible to provide a highly reliable liquid discharge head whose discharge characteristics are stabilized when liquid is discharged by utilizing the displacement of the free end of the movable member by the pressure exerted by the creation of bubbles by the application of the present embodiment by itself, and also, to make it possible to provide a highly reliable liquid discharge head whose discharge characteristics are synergically stabilized by arranging this embodiment to be applicable to each of the embodiments described earlier.

Figure 16A:
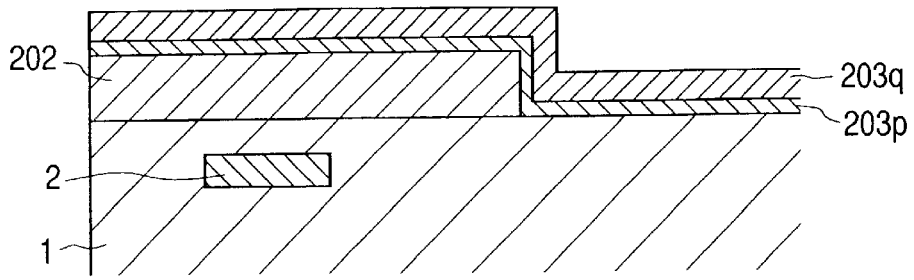
FIGS. 16A, 16B, 16C, 16D and 16E are explanatory views on the film formation process of an SiN film constituting the movable plate in a fifth embodiment of this invention.
Figure 16B:
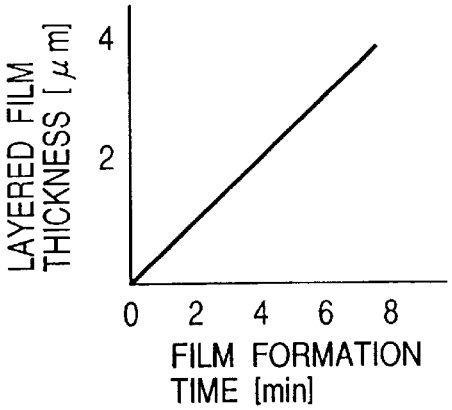
Figure 16D:
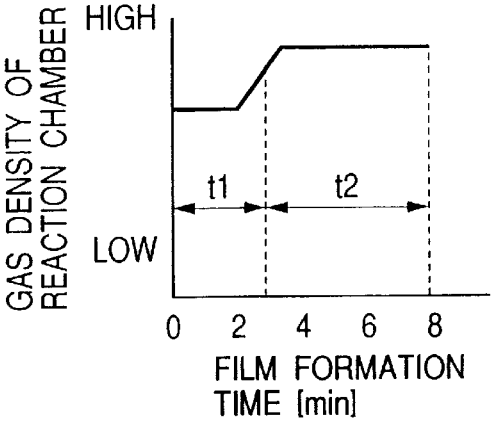
Figure 16C:
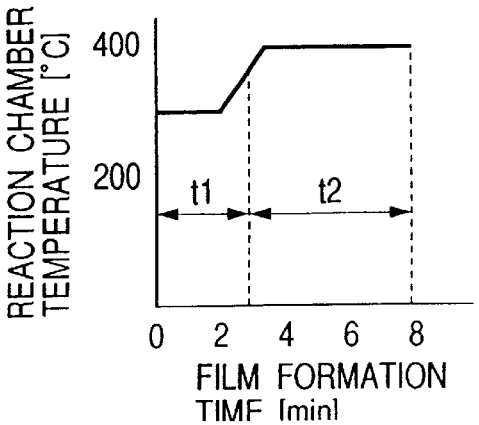
Figure 16E:
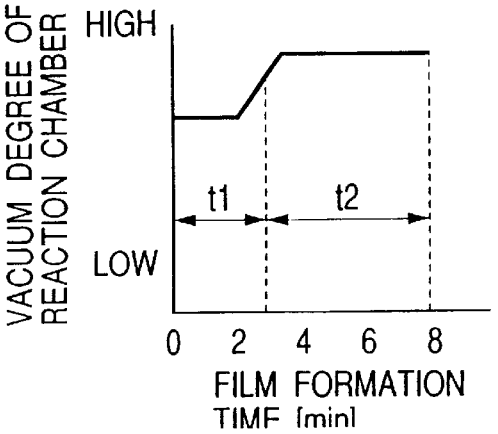

FIG. 16A is a cross-section view which shows schematically the principal part of the movable member in the manufacturing process thereof in accordance with the fifth embodiment of the present invention. In this respect, each of the embodiments described above is applicable to the structure of the recording head as a whole. Therefore, the detailed description thereof will be omitted. Here, a combination is made with the third embodiment, the film for the formation of the movable members is formed on the pedestals, but not on the substrate.

The movable member shown in FIG. 16A if formed by the CVD apparatus as shown in FIG. 14C. Here, as in the fourth embodiment, At the start of the film lamination and in the initial stage of the development, the lamination temperature is set at approximately 300° C., and it is raised gradually. When the lamination temperature reaches a temperature of approximately 400° C., it is kept constantly. Then, the lamination is continues as it is until the desired film thickness is obtained (see FIG. 16B). At this juncture, the film thickness is increased almost constantly (see FIG. 16C). However, the film quality of the film 203*p* in the initial lamination (the film formed at t1 in FIG. 16B) has a lower density-than that of the film quality of the film 203*q* formed in the condition at a higher lamination temperature (the film formed at t2 in FIG. 16B). The density thereof becomes higher in the laminating direction.

As described above, with the formation of sparse portion on the closely connected portion between the movable member and the surface of the elemental substrate 1, it becomes possible to suppress the abrupt stress changes of the film for the formation of the movable member, hence making the bonding power of the close contact portion, while suppressing the hillocks or whiskers on the Al sacrifice layer. As a result, a highly reliable liquid discharge head can be provided with stabilized discharge characteristics when liquid is discharged by utilizing the displacement of the free and of the movable member by the pressure exerted by the creation of bubbles by the application of the present embodiment itself.

Here, for the fourth embodiment and the present embodiment, the description has been made of the temperature in the reaction chamber as one of the examples in which the density of the film formation material is to be changed. However, the changes of the material density for film formation is not necessarily limited to the temperature changes. For example, by the flow rate of gas to be supplied into the reaction chamber through the supply tube (see FIG. 16D) or by the degree of vacuum in the reaction chamber (see FIG. 16E), such changes may be possible. In each of the cases where other factors are fixed, if the gas concentration is high in the reaction chamber with larger gas flow rate, and the degree of vacuum is high, the material becomes more dense. Now, therefore, in FIG. 16D and FIG. 17E, it becomes possible to form the SiN film 203*p* in the film formation at t1, and SiN film 203*q* in the film formation at t2, respectively.

In this respect, the sparse and denseness of the material is not necessarily limited to the one that contains Si at the time of the film formation of the kind. The present embodiment is applicable to the case where other metal is used as the material for the formation of the movable member.

Other Embodiments

A liquid discharge head cartridge on which the liquid discharge head as above described is mounted will be roughly described below.

Figure 17:
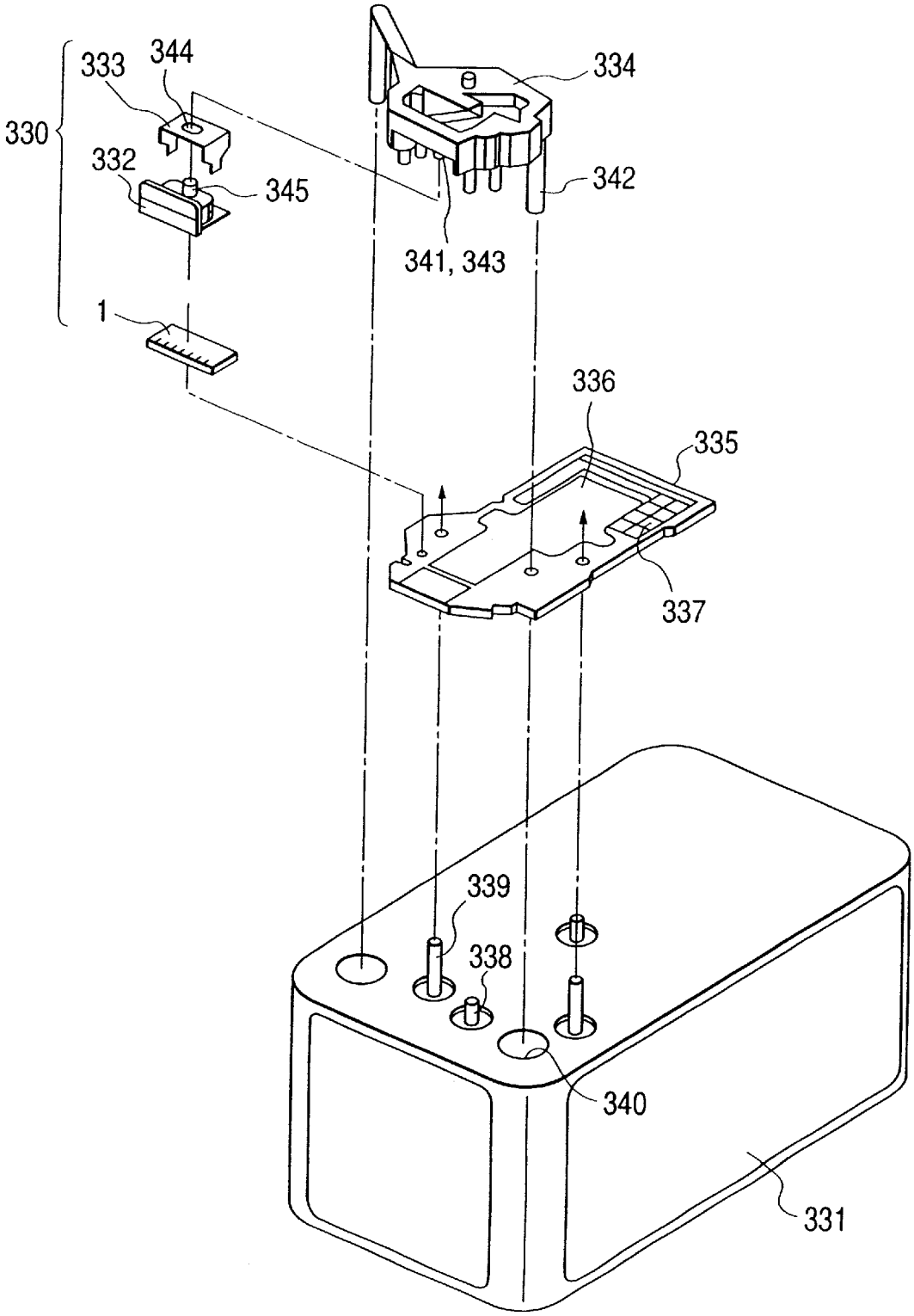
FIG. 17 is a typical exploded view of a liquid discharge head cartridge having the liquid discharge head mounted thereon.

FIG. 17 is a typical exploded perspective view of the liquid discharge head cartridge on which the liquid discharge head is mounted. As shown in FIG. 17, the liquid discharge head cartridge is mainly constituted of a liquid discharge head portion 330 and a liquid container 331.

The liquid discharge head portion 330 is composed of an element substrate 1 provided with a movable plate 31 (see FIG. 3), a grooved member 332 having a ceiling plate 50 and an orifice plate 51 (see FIG. 3), a presser spring 333, a liquid supply member 334, and a support base (aluminum base plate) 335. The element substrate 1 is provided with a plurality of heat generators 2 (see FIG. 3) for applying heat to the foaming liquid, as previously described, in a column, and a plurality of functional elements (not shown) for selectively driving the heat generators 2. Between the element substrate 1 and the movable plate 31 is formed a bubble producing region 11 (see FIG. 3) as previously described. By bonding this element substrate 1 with the grooved member 33, the liquid flow passages 10 through which the liquid to be discharged flows and a common liquid chamber 13 (see FIG. 3) are formed.

The presser spring 333 is a member for applying a biasing force toward the element substrate 1 to the grooved member 332, and owing to this biasing force, the element substrate 1, the grooved member 332 and the support base 335 can be integrated together favorably.

The support base 335 supports the element substrate 1, and further has disposed thereon a printed wiring substrate 336 for supplying an electrical signal to the element substrate 1 which is connected to it, and a contact pad 337 for passing and receiving the electrical signal to and from the apparatus connecting to it.

The liquid container 331 contains the discharge liquid such as the ink to be supplied to the liquid discharge head portion 330. Outside of the liquid container 331, there are provided a locating portion 338 for placing a connecting member for connecting the liquid discharge head portion 330 and the liquid container 331, and a fixture shaft 339 for fixing the connecting member. The supply of the liquid to be discharged occurs from a discharge liquid supply passage 340 of the liquid container 331 via a supply passage 342 of the liquid supply member 334, and a supply passage 341, 343, 344 of each member to the common liquid chamber 13 (see FIG. 3).

Note that this liquid container 331 may be used by refilling the liquid after consumption of the liquid. For this purpose, it is desirable to provide a liquid filler hole in the liquid container 331. Also, note that the liquid discharge head portion 330 and the liquid container 331 may be integrated or separated.

Figure 18:
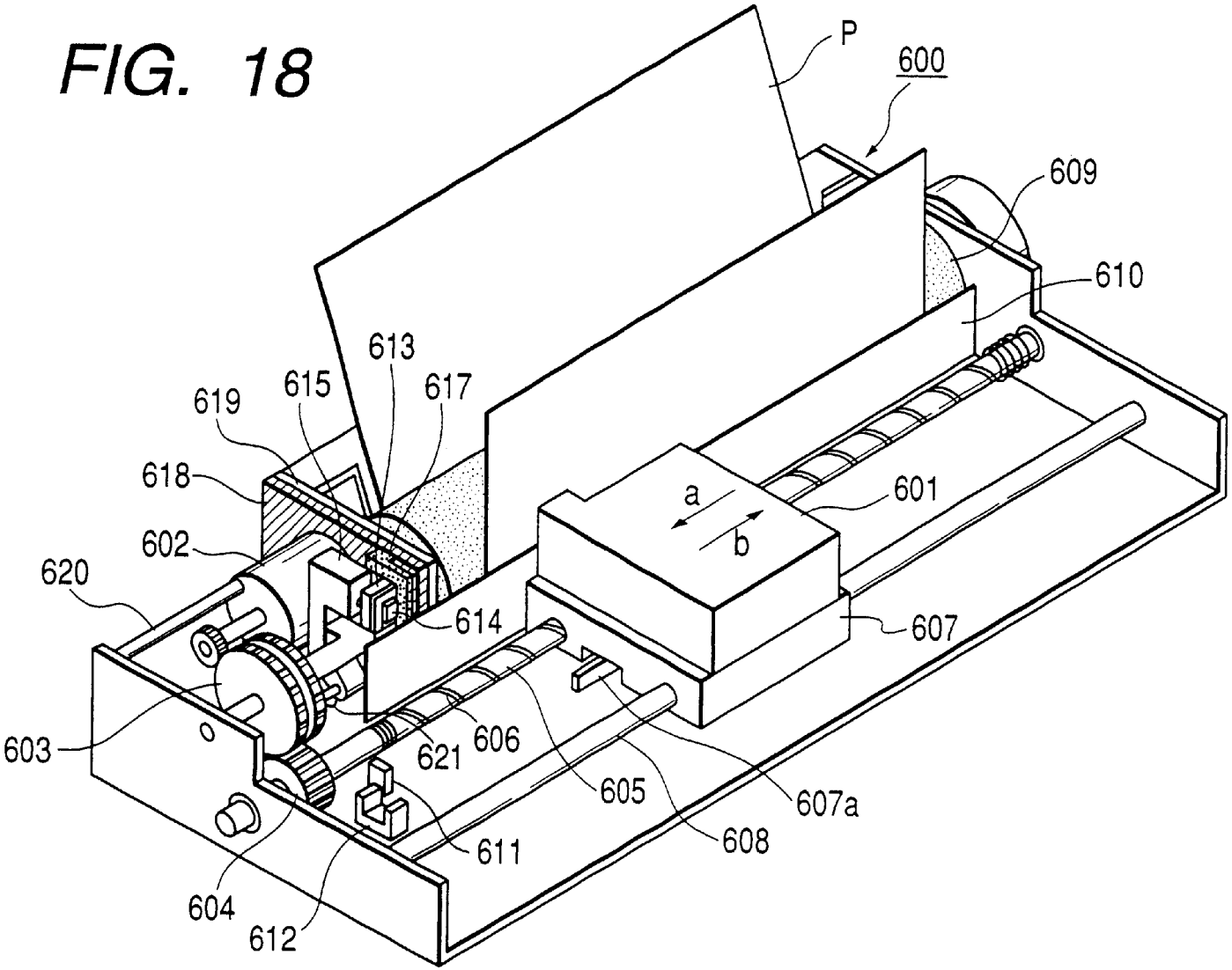
FIG. 18 is a schematic perspective view illustrating an ink jet recording apparatus onto which the liquid discharge head of this embodiment can be mounted.
Figure 19A:
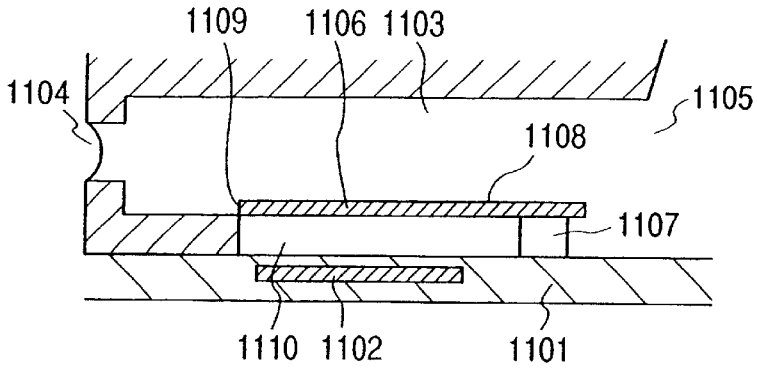
PRIOR ART FIG. 19A
FIGS. 19A, 19B, 19C and 19D are views for explaining the discharge principle in a conventional liquid discharge head.
Figure 19B:
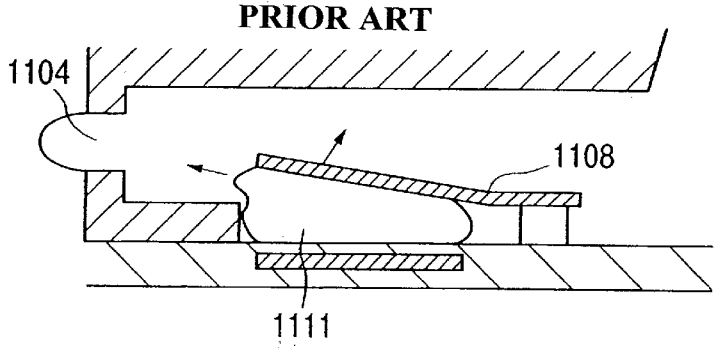
PRIOR ART FIG. 19B
Figure 19C:
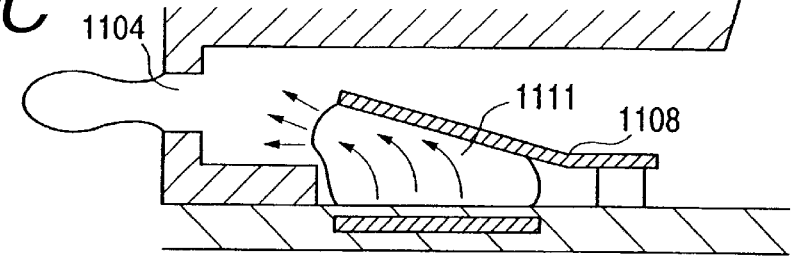
PRIOR ART FIG. 19C
Figure 19D:
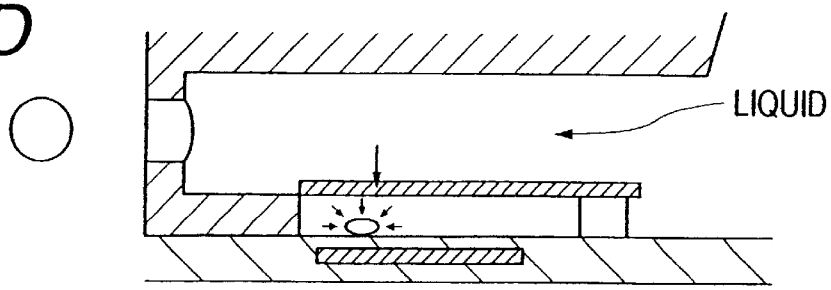
PRIOR ART FIG. 19D
Figure 20A:
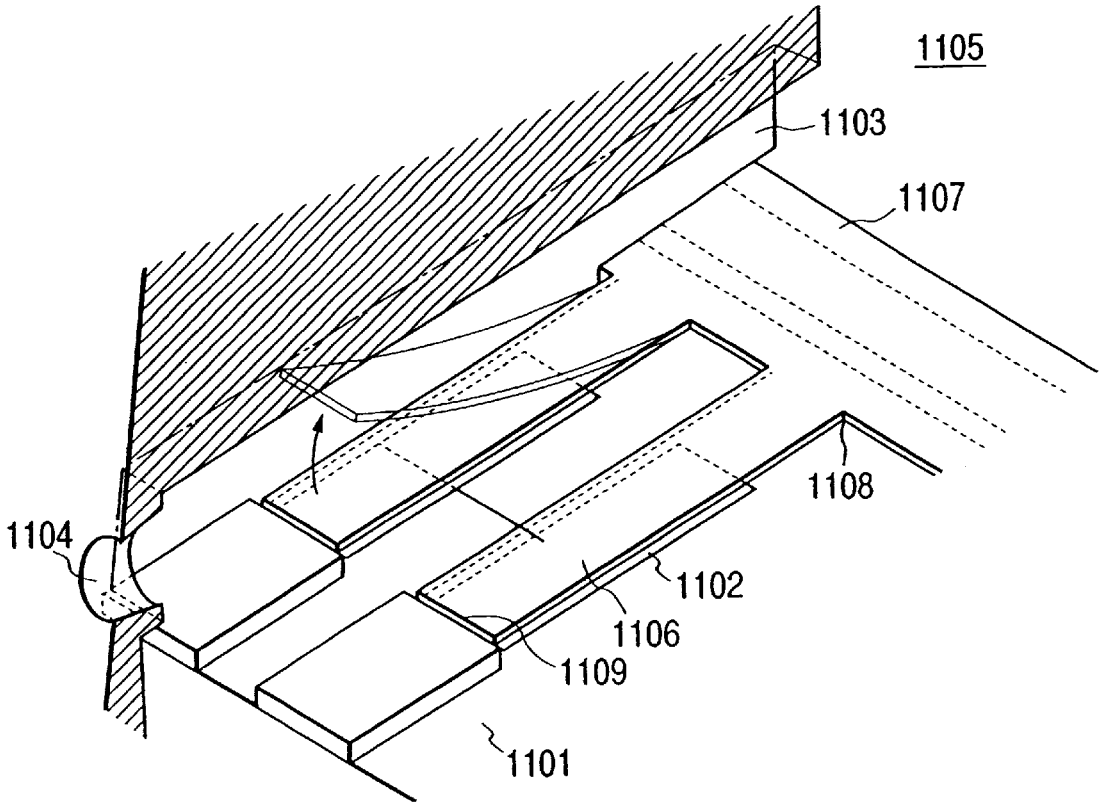
FIGS. 20A and 20B are cross-sectional views illustrating a conventional liquid discharge head.
Figure 20B:
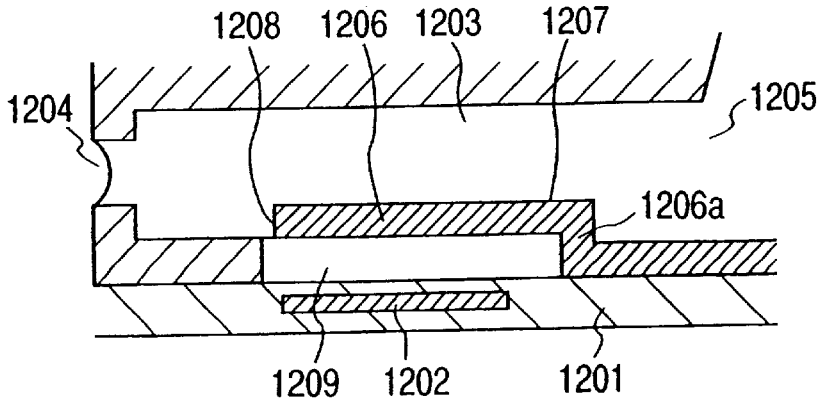
PRIOR ART FIG. 20B

FIG. 18 is a schematic perspective view exemplifying an ink jet recording apparatus onto which the liquid discharge head of this embodiment can be mounted.

In FIG. 18, numeral 601 represents an ink jet recording head of this embodiment. This head 601 is mounted on a carriage 607 which engages a spiral groove 606 of a lead screw 605 revolving via the driving force transmissions 603, 604 along with the positive or reverse revolution of a driving motor 602, and reciprocated in the directions of the arrows a and b along a guide 608, together with the carriage 607, by motive power of the driving motor 602. A paper pressing plate 610 for a print sheet P (recording medium) to be conveyed over a platen 609 by a recording medium conveying device, not shown, presses the print sheet P onto the platen 609 over the carriage movement direction.

Near one end of the lead screw 605, there are disposed photo-couplers 611 and 612. These are home position detecting means for checking the presence of a lever 607*a* of the carriage 607 in this region to change the rotational direction of the driving motor 602. In the figure, numeral 613 represents a support member for supporting a cap member 614 which covers a front face of the ink jet recording head 601 as above described where the discharge openings are provided. Numeral 615 represents ink suction means for sucking the ink accumulated inside of the cap member 614 by idle discharge from the head 601. By this suction means 615, the head 601 is subjected to suction recovery via an opening portion 616 within the cap. Numeral 617 represents a cleaning blade, and numeral 618 represents a moving member for moving the blade 617 in the cross direction (direction orthogonal to the moving direction of the carriage 607), the blade 617 and the moving member 618 being supported on a main body supporting base 619. The above blade 617 is not limited thereto, but may be any of other well-known cleaning blades. Numeral 620 represents a lever for starting the suction in the suction recovery operation, which is moved with the movement of a cam 621 engaged with the carriage 607, the driving force from the driving motor 602 being controlled for movement by well-known transmission means such as a clutch. An ink jet recording controller for applying a signal to the heat generator 2 provided on the head 601 and controlling the driving of each mechanism as previously described is provided on the main apparatus and not illustrated herein.

The ink jet recording apparatus 600 having the above-described constitution allows the head 601 to perform the recording on a print sheet P (recording medium) conveyed over the platen 609 by a recording medium conveying device not shown, while reciprocating over the entire width of the print sheet P.

What is claimed is:

1. A liquid discharge head at least comprising:

a discharge opening for discharging a liquid;

a liquid flow channel in communication with said discharge opening and for supplying said liquid to said discharge opening;

a substrate equipped with a heat generator for producing a bubble in the liquid that is filled in the liquid flow channel; and a movable plate supported and fixed onto said substrate at a position of said substrate opposed to said heat generator and with a gap from said substrate, with a free end on the discharge opening side, said liquid discharge head discharging the liquid from said discharge openings by forcing the free end of said movable plate to be displaced toward said discharge opening around a fulcrum portion made near a supporting and fixing portion of said movable plate with said substrate due to pressure caused by produced bubble, wherein said movable plate is formed in a film formation process at least two times or more.

2. A liquid discharge head according to claim 1 wherein a film containing silicon as the composition thereof is formed in said film formation process of two times or more.

3. A liquid discharge head according to claim 2, wherein the material of said movable plate is silicone nitride, silicone oxide or silicone carbide.

4. A liquid discharge head according to claim 1, wherein an oxide thin film is provided between each layer constituting said movable plate.

5. A liquid discharge head according to claim 1, wherein said movable plate is formed by plasma CVD.

6. A liquid discharge head according to claim 1, wherein the peripheral end face of said movable plate is like a saw-tooth in a thickness direction of said movable plate.

7. A liquid discharge head according to claim 1, wherein the outer peripheral end face of said movable plate is in the form of saw teeth in the direction intersecting the thickness direction of said movable plate.

8. A liquid discharge head at least comprising:

a discharge opening for discharging a liquid;

a liquid flow channel in communication with said discharge opening and for supplying said liquid to said discharge opening;

a substrate equipped with a heat generator for producing a bubble in the liquid that is filled in the liquid flow channel; and a movable plate supported and fixed onto said substrate at a position of said substrate opposed to said heat generator and with a gap from said substrate, with a free end on the discharge opening side, said liquid discharge head discharging the liquid from said discharge opening, by forcing the free end of said movable plate to be displaced toward said discharge opening around a fulcrum portion made near a supporting and fixing portion of said movable plate with said substrate due to pressure caused by produced bubble, wherein said movable plate is formed in a laminated structure having three layers or more each having different Young's modulus from the adjacent layer.

9. A liquid discharge head according to claim 8, wherein said movable plate has such a structure that the layer having comparatively low Young's modulus is between the layers each having comparatively high Young's modulus.

10. A liquid discharge head according to claim 9, wherein the material for forming a layer having relatively low Young's modulus is silicone oxide.

11. A liquid discharge head according to claim 9, wherein the material for forming the layer having relatively high Young's modulus is silicone nitride or silicone carbide.

12. A liquid discharge head according to claim 9, wherein said movable plate is formed with the same material, and at the same time, the density of material for said layer having comparatively low Young's modulus is thinner than that of the material forming the high Young's modulus.

13. A liquid discharge head according to claim 8, wherein a plate base is provided between a supporting and fixing portion of said movable plate and said substrate.

14. A liquid discharge head according to claim 13, wherein the material for said plate base contains Ti.

15. A liquid discharge head according to claim 13, wherein the material for said plate base contains tantalum.

16. A liquid discharge head according to claim 8, wherein the outer peripheral end face of said movable plate is in the form of saw teeth in the direction intersecting the thickness direction of said movable plate.

17. A liquid discharge head according to claim 8, wherein said movable plate is formed in the laminated structure having three layers or more each having different Young's modulus from the adjacent layer.

18. A liquid discharge head comprising at least:

discharge ports for discharging liquid;

liquid flow paths communicated with said discharge ports for supplying said liquid to said discharge ports;

a substrate provided with heat generating elements for creating bubbles in said liquid filled in each of said liquid flow paths; and movable members arranged in a position facing said heat generating elements on said substrate with a gap thereto, and supported and fixed on the substrate with a free end thereof being on said discharge port side, and said liquid being discharged from said discharge ports by displacing the free end of said movable members to said discharge port side centering on the fulcrum structured near the supporting and fixing portion of said movable members with said substrate, wherein the outer peripheral end face of said movable members is in the form of saw teeth in the thickness direction of the movable members.

19. A liquid discharge head comprising at least:

discharge ports for discharging liquid;

liquid flow paths communicated with said discharge ports for supplying said liquid to said discharge ports;

a substrate provided with heat generating elements for creating bubbles in said liquid filled in each of said liquid flow paths; and movable members arranged in a position facing said heat generating elements on said substrate with a gap thereto, and supported and fixed on the substrate with a free end thereof being on said discharge port side, and said liquid being discharged from said discharge ports by displacing the free end of said movable members to said discharge port side centering on the fulcrum structured near the supporting and fixing portion of said movable members with said substrate, wherein the outer peripheral end face of said movable members is in the form of saw teeth in the direction intersecting the thickness direction of the movable members.

20. A liquid discharge head according to claim 19, wherein said movable members are formed in one-time film formation process.

21. A liquid discharge head comprising:

discharge ports for discharging liquid;

a substrate provided with liquid flow paths communicated with said discharge ports for supplying said liquid to said discharge ports, and heat generating elements for creating bubbles in said liquid filled in each of said liquid flow paths; and movable members arranged in a position facing said heat generating elements on said substrate with a gap thereto, and supported and fixed on the substrate with a free end thereof being on said discharge port side, and said liquid being discharged from said discharge ports by displacing the free end of said movable members to said discharge port side centering on the fulcrum structured near the supporting and fixing portion of said movable members with said substrate, wherein the density of the material for the formation of said movable members in a bonding area with said substrate is smaller than the density of the material for the formation of said movable members apart from the bond area.

22. A liquid discharge head comprising:

discharge ports for discharging liquid;

a substrate provided with liquid flow paths communicated with said discharge ports for supplying said liquid to said discharge ports, and heat generating elements for creating bubbles in said liquid filled in each of said liquid flow paths; and movable members arranged in a position facing said heat generating elements on said substrate with a gap thereto, and supported and fixed on the substrate with a free end thereof being on said discharge port side, and said liquid being discharged from said discharge ports by displacing the free end of said movable members to said discharge port side centering on the fulcrum structured near the supporting and fixing portion of said movable members with said substrate, wherein a pedestal portion is arranged between the supporting and fixing portion of said movable members and said substrate, and at the same time, the density of the material for the formation of said movable members in a bonding area with said pedestal portion is smaller than the density of the material for the formation of said movable members apart from the bonding area.

23. A head cartridge having a liquid discharge head and a liquid container for holding the liquid to be supplied to said liquid discharge head, wherein said liquid discharge head at least comprises:

a discharge opening for discharging a liquid;

a liquid flow channel in communication with said discharge opening and for supplying said liquid to said discharge opening;

a substrate equipped with a heat generator for producing a bubble in the liquid that is filled in the liquid flow channel; and a movable plate supported and fixed onto said substrate at a position of said substrate opposed to said heat generator and with a gap from said substrate, with a free end on the discharge opening side, said liquid discharge head discharging the liquid from said discharge opening by forcing the free end of said movable plate to be displaced toward said discharge opening around a fulcrum portion made near a supporting and fixing portion of said movable plate with said substrate due to pressure caused by produced bubble, wherein said movable plate is formed in the film formation process at least two times or more.

24. A liquid discharge apparatus having a liquid discharge head and a drive signal supplying means for supplying a drive signal to discharge ink from said liquid discharge head, characterized in that said liquid discharge apparatus performs a recording by discharging ink from said liquid discharge head and applying said ink onto a recording medium, wherein said liquid discharge head at least comprises:

a discharge opening for discharging ink;

a liquid flow channel in communication with said discharge opening and for supplying the ink to said discharge opening;

a substrate equipped with a heat generator for producing a bubble in the ink that is filled in the liquid flow channel; and a movable plate supported and fixed onto said substrate at a position of said substrate opposed to said heat generator and with a gap from said substrate, with a free end on the discharge opening side, said liquid discharge head discharging the ink from said discharge opening by forcing the free end of said movable plate to be displaced toward said discharge opening around a fulcrum portion made near a supporting and fixing portion of said movable plate with said substrate due to pressure caused by produced bubble, wherein said movable plate is formed in the film formation process at least two times or more.

25. A head cartridge having a liquid discharge head and a liquid container for holding a liquid to be supplied to said liquid discharge head, wherein said liquid discharge head at least comprises:

a discharge opening for discharging the liquid;

a liquid flow channel in communication with said discharge opening and for supplying the liquid to said discharge opening;

a substrate equipped with a heat generator for producing a bubble in the liquid that is filled in the liquid flow channel; and a movable plate supported and fixed onto said substrate at a position of said substrate opposed to said heat generator and with a gap from said substrate, with a free end on the discharge opening side, said liquid discharge head discharging the liquid from said discharge opening by forcing the free end of said movable plate to be displaced toward said discharge opening around a fulcrum portion made near a supporting and fixing portion of said movable plate with said substrate due to pressure caused by produced bubble, wherein said movable plate is formed in a laminated structure having three layers or more each having different Young's modulus from the adjacent layer.

26. A head cartridge having a liquid discharge head and a liquid container for holding the liquid to be supplied to said liquid discharge head, wherein said liquid discharge head at least comprising:

discharge ports for discharging liquid;

liquid flow paths communicated with said discharge ports for supplying said liquid to said discharge ports;

a substrate provided with heat generating elements for creating bubbles in said liquid filled in each of said liquid flow paths; and movable members arranged in a position facing said heat generating elements on said substrate with a gap thereto, and supported and fixed on the substrate with a free end thereof being on said discharge port side, and said liquid being discharged from said discharge ports by displacing the free end of said movable members to said discharge port side centering on the fulcrum structured near the supporting and fixing portion of said movable members with said substrate, wherein the outer peripheral end face of said movable members is in the form of saw teeth in the thickness direction of the movable members.

27. A head cartridge having a liquid discharge head and a liquid container for holding the liquid to be supplied to said liquid discharge head, wherein said liquid discharge head at least comprising:

discharge ports for discharging liquid;

liquid flow paths communicated with said discharge ports for supplying said liquid to said discharge ports;

a substrate provided with heat generating elements for creating bubbles in said liquid filled in each of said liquid flow paths; and movable members arranged in a position facing said heat generating elements on said substrate with a gap thereto, and supported and fixed on the substrate with a free end thereof being on said discharge port side, and said liquid being discharged from said discharge ports by displacing the free end of said movable members to said discharge port side centering on the fulcrum structured near the supporting and fixing portion of said movable members with said substrate, wherein the outer peripheral end face of said movable members is in the form of saw teeth in the direction intersecting the thickness direction of the movable members.

28. A head cartridge having a liquid discharge head and a liquid container for holding the liquid to be supplied to said liquid discharge head, wherein said liquid discharge head at least comprising:

discharge ports for discharging liquid;

a substrate provided with liquid flow paths communicated with said discharge ports for supplying said liquid to said discharge ports, and heat generating elements for creating bubbles in said liquid filled in each of said liquid flow paths; and movable members arranged in a position facing said heat generating elements on said substrate with a gap thereto, and supported and fixed on the substrate with a free end thereof being on said discharge port side, and said liquid being discharged from said discharge ports by displacing the free end of said movable members to said discharge port side centering on the fulcrum structured near the supporting and fixing portion of said movable members with said substrate, wherein the density of the material for the formation of said movable members in a bonding area with said substrate is smaller than the density of the material for the formation of said movable members apart from the bonding area.

29. A head cartridge having a liquid discharge head and a liquid container for holding the liquid to be supplied to said liquid discharge head, wherein said liquid discharge head at least comprising:

discharge ports for discharging liquid;

a substrate provided with liquid flow paths communicated with said discharge ports for supplying said liquid to said discharge ports, and heat generating elements for creating bubbles in said liquid filled in each of said liquid flow paths; and movable members arranged in a position facing said heat generating elements on said substrate with a gap thereto, and supported and fixed on the substrate with a free end thereof being on said discharge port side, and said liquid being discharged from said discharge ports by displacing the free end of said movable members to said discharge port side centering on the fulcrum structured near the supporting and fixing portion of said movable members with said substrate, wherein a pedestal portion is arranged between the supporting and fixing portion of said movable members and said substrate, and at the same time, the density of the material for the formation of said movable members in a bonding area with said pedestal portion is smaller than the density of the material for the formation of said movable members apart from the bonding area.

30. A liquid discharge apparatus having a liquid discharge head and a drive signal supplying means for supplying a drive signal to discharge ink from said liquid discharge head, characterized in that said liquid discharge apparatus performs a recording by discharging ink from said liquid discharge head and applying said ink onto a recording medium, wherein said liquid discharge head at least comprising:

a discharge opening for discharging the liquid;

a liquid flow channel in communication with said discharge opening and for supplying said liquid to said discharge opening;

a substrate equipped with a heat generator for producing a bubble in the liquid that is filled in the liquid flow channel; and a movable plate supported and fixed onto said substrate at a position of said substrate opposed to said heat generator and with a gap from said substrate, with a free end on the discharge opening side, said liquid discharge head discharging the liquid from said discharge opening by forcing the free end of said movable plate to be displaced toward said discharge opening around a fulcrum portion made near a support and fixing portion of said movable plate with said substrate due to pressure caused by produced bubble, wherein said movable plate is formed in a laminated structure having three layers or more each having different Young's modulus from the adjacent layer.

31. A liquid discharge apparatus having a liquid discharge head and a drive signal supplying means for supplying a drive signal to discharge ink from said liquid discharge head, characterized in that said liquid discharge apparatus performs a recording by discharging ink from said liquid discharge head and applying said ink onto a recording medium, wherein said liquid discharge head at least comprising:

discharge ports for discharging liquid, liquid flow paths communicated with said discharge ports for supplying said liquid to said discharge ports;

a substrate provided with heat generating elements for creating bubbles in said liquid filled in each of said liquid flow paths; and movable members arranged in a position facing said heat generating elements on said substrate with a gap thereto, and supported and fixed on the substrate with a free end thereof being on said discharge port side, and said liquid being discharged from said discharge ports by displacing the free end of said movable members to said discharge port side centering on the fulcrum structured near the supporting and fixing portion of said movable members with said substrate, wherein the outer peripheral end face of said movable members is in the form of saw teeth in the thickness direction of the movable members.

32. A liquid discharge apparatus having a liquid discharge head and a drive signal supplying means for supplying a drive signal to discharge ink from said liquid discharge head, characterized in that said liquid discharge apparatus performs a recording by discharging ink from said liquid discharge head and applying said ink onto a recording medium, wherein said liquid discharge head at least comprising:

discharge ports for discharging liquid;

liquid flow paths communicated with said discharge ports for supplying said liquid to said discharge ports;

a substrate provided with heat generating elements for creating bubbles in said liquid filled in each of said liquid flow paths; and movable members arranged in a position facing said heat generating elements on said substrate with a gap thereto, and supported and fixed on the substrate with a free end thereof being on said discharge port side, and said liquid being discharged from said discharge ports by displacing the free end of said movable members to said discharge port side centering on the fulcrum structured near the supporting and fixing portion of said movable members with said substrate, wherein the outer peripheral end face of said movable members is in the form of saw teeth in the direction intersecting the thickness direction of the movable members.

33. A liquid discharge apparatus having a liquid discharge head and a drive signal supplying means for supplying a drive signal to discharge ink from said liquid discharge head, characterized in that said liquid discharge apparatus performs a recording by discharging ink from said liquid discharge head and applying said ink onto a recording medium, wherein said liquid discharge head at least comprising:

discharge ports for discharging liquid;

a substrate provided with liquid flow paths communicated with said discharge ports for supplying said liquid to said discharge ports, and heat generating elements for creating bubbles in said liquid filled in each of said liquid flow paths; and movable members arranged in a position facing said heat generating elements on said substrate with a gap thereto, and supported and fixed on the substrate with a free end thereof being on said discharge port side, and said liquid being discharged from said discharge ports by displacing the free end of said movable members to said discharge port side centering on the fulcrum structured near the supporting and fixing portion of said movable members with said substrate, wherein the density of the material for the formation of said movable members in a bonding area with said substrate is smaller than the density of the material for the formation of said movable members apart from the bonding area.

34. A liquid discharge apparatus having a liquid discharge head and a drive signal supplying means for supplying a drive signal to discharge ink from said liquid discharge head, characterized in that said liquid discharge apparatus performs a recording by discharging ink from said liquid discharge head and applying said ink onto a recording medium, wherein said liquid discharge head at least comprising:

discharge ports for discharging liquid;

a substrate provided with liquid flow paths communicated with said discharge ports for supplying said liquid to said discharge ports, and heat generating elements for creating bubbles in said liquid filled in each of said liquid flow paths; and movable members arranged in a position facing said heat generating elements on said substrate with a gap thereto, and supported and fixed on the substrate with a free end thereof being on said discharge port side, and said liquid being discharged from said discharge ports by displacing the free end of said movable members to said discharge port side centering on the fulcrum structured near the supporting and fixing portion of said movable members with said substrate, wherein a pedestal portion is arranged between the supporting and fixing portion of said movable members and said substrate, and at the same time, the density of the material for the formation of said movable members in a bonding area with said pedestal portion is smaller than the density of the material for the formation of said movable members apart from the bonding area.

* * * * *

UNITED STATES PATENT AND TRADEMARK OFFICE

CERTIFICATE OF CORRECTION

PATENT NO. : 6,464,342 B1
DATED : October 15, 2002
INVENTOR(S) : Masahiko Kubota et al.

It is certified that error appears in the above-identified patent and that said Letters Patent is hereby corrected as shown below:

Column 3,
Line 41, "]" should be deleted; and
Line 48, "above described," should read -- described above, --.

Column 5,
Line 12, "turbulent" should read -- turbulence --; and
Line 55, "slid" should read -- slide --.

Column 8,
Line 24, "of:" should read -- of --.

Column 9,
Line 43, "views-showing" should read -- views showing --.

Column 10,
Line 19, "represents" (second occurrence) should be deleted.

Column 12,
Line 25, "above mentioned." should read -- above-mentioned. --.

Column 14,
Line 3, "above cited." should read -- cited above. --.

Column 15,
Line 19, "the" (first occurrence) should read -- this --.

Column 17,
Line 7, "above" should read -- above- --.

Column 19,
Line 21, "above described," should read -- above-described, --.

Column 20,
Line 58, "the-section" should read -- the section --.

Column 21,
Line 4, "differ" should read -- differs --;
Line 5, "For the" should read -- As --; and
Line 37, "can" should read -- can be --.

UNITED STATES PATENT AND TRADEMARK OFFICE

CERTIFICATE OF CORRECTION

PATENT NO. : 6,464,342 B1
DATED : October 15, 2002
INVENTOR(S) : Masahiko Kubota et al.

It is certified that error appears in the above-identified patent and that said Letters Patent is hereby corrected as shown below:

Column 24,
Line 47, “ings” should read -- ing --; and
Line 54, “claim 1” should read -- claim 1, --.

Column 25,
Line 18, “opening,” should read -- opening --.

Column 28,
Lines 25 and 49, “comprising:” should read -- comprises: --.

Column 29,
Lines 5, 31 and 63, “comprising:” should read -- comprises: --.

Column 30,
Lines 24 and 52, “comprising:” should read -- comprises: --;
Line 25, “liquid,” should read -- liquid; --.

Column 31,
Line 13, “comprising:” should read -- comprises: --.

Column 32,
Line 8, “comprising:” should read -- comprises: --.

Signed and Sealed this

Twentieth Day of December, 2005

JON W. DUDAS
*Director of the United States Patent and Trademark Office*